US008094847B2

(12) United States Patent
Roeck et al.

(10) Patent No.: US 8,094,847 B2
(45) Date of Patent: Jan. 10, 2012

(54) METHOD FOR MANUFACTURING ACOUSTICAL DEVICES AND FOR REDUCING ESPECIALLY WIND DISTURBANCES

(75) Inventors: Hans-Ueli Roeck, Hombrechtikon (CH); Silvia Allegro-Baumann, Unteraegeri (CH); Franziska Pfisterer, Birmensdof (CH)

(73) Assignee: Phonak AG, Stafa (CH)

( * ) Notice: Subject to any disclaimer, the term of this patent is extended or adjusted under 35 U.S.C. 154(b) by 129 days.

(21) Appl. No.: 12/354,851

(22) Filed: Jan. 16, 2009

(65) Prior Publication Data

US 2009/0123009 A1 May 14, 2009

Related U.S. Application Data

(62) Division of application No. 11/537,709, filed on Oct. 2, 2006, now Pat. No. 7,492,916, and a division of application No. 10/378,453, filed on Mar. 3, 2003, now Pat. No. 7,127,076.

(51) Int. Cl.
*H04R 25/00* (2006.01)

(52) U.S. Cl. ..... 381/312; 381/94.1; 381/316

(58) Field of Classification Search ..... 381/312, 381/316–318, 94.1–94.3
See application file for complete search history.

(56) References Cited

U.S. PATENT DOCUMENTS

| | | | | |
|---|---|---|---|---|
| 5,170,434 | A * | 12/1992 | Anderson | 381/317 |
| 5,285,502 | A * | 2/1994 | Walton et al. | 381/94.2 |
| 6,647,123 | B2 * | 11/2003 | Kandel et al. | 381/318 |
| 7,418,379 | B2 * | 8/2008 | Vierthaler | 704/225 |
| 2002/0037088 | A1 | 3/2002 | Dickel et al. | |
| 2002/0057808 | A1 | 5/2002 | Goldstein | |
| 2002/0150264 | A1 | 10/2002 | Allegro et al. | |
| 2004/0109578 | A1 | 6/2004 | Niederdrank et al. | |

FOREIGN PATENT DOCUMENTS

| | | | |
|---|---|---|---|
| DE | 3733983 | A1 | 4/1989 |
| EP | 0588526 | A1 | 3/1991 |
| EP | 0843427 | A1 | 5/1998 |
| EP | 1351544 | A2 | 10/2003 |
| WO | 8700366 | A1 | 1/1987 |
| WO | 9710586 | A1 | 3/1997 |
| WO | 0131972 | A1 | 5/2001 |
| WO | 03015460 | A2 | 2/2003 |

* cited by examiner

*Primary Examiner* — Suhan Ni
(74) *Attorney, Agent, or Firm* — Pearne & Gordon LLP

(57) ABSTRACT

A method for manufacturing an acoustical device, especially a hearing device. A device casing is provided with an acoustical/electrical input converter arrangement with an electric output. An audio signal processing unit establishes audio signal processing of the device according to individual needs and/or purpose of the device. At least one electrical/mechanical output converter is provided. A filter arrangement with adjustable high-pass characteristic has a control input for the characteristic. The following operational connections are established: between the output of the input converter arrangement and the input of the filter arrangement, between the output of the filter arrangement and the control input, between said output of the filter arrangement and the input of the processing unit, between the output of the processing unit and the input of the at least once output converter.

8 Claims, 10 Drawing Sheets

METHOD FOR MANUFACTURING ACOUSTICAL DEVICES AND FOR REDUCING ESPECIALLY WIND DISTURBANCES

CROSS-REFERENCE TO RELATED APPLICATIONS

The present application is a division of application Ser. No. 11/537,709 filed on Oct. 2, 2006 and a division of application Ser. No. 10/378,453 filed on Mar. 3, 2003, both of which are incorporated herewith by reference.

BACKGROUND OF THE INVENTION

1. Field of the Invention

The present invention relates to the electronic cancellation of wind noise and more particularly to a method of manufacturing acoustical devices that incorporate the electronic cancellation of wind noise.

2. Description of Related Art

The present invention departs generally from the need of canceling wind disturbances from desired acoustical source reception as of speech or music etc. Wind noise in hearing devices is a severe problem. Wind noise may reach magnitudes of 100 dB SPL (Sound Pressure Level) and even more. Users of hearing devices therefore often switch their device off in windy conditions, because acoustical perception with the hearing device in windy surrounding may become worse than without the hearing device.

Approaches are known to counteract wind noise by mechanical constructional measures, but cannot eliminate wind noise completely, often even not to a completely satisfying degree. It is well-known that wind noise is a low-frequency phenomenon. Depending upon wind speed, direction of the wind with respect to the device, hair length of the individual, mechanical obstructions like hats and other factors, magnitude and spectral content of wind noise vary significantly. With respect to noise, effects and causes we refer to H. Dillon et al., "The sources of wind noise in hearing aids", IHCON 2000, as well as to I. Roe et al., "Wind noise in hearing aids: Causes and effects", submitted to JASA.

Wind signals at sensing ports or acoustical/electrical input converters of hearing devices mounted with a predetermined spacing are far less correlated than are normal acoustical signals to be perceived, as especially speech, music etc.

One reason is that such normal acoustical signals arrive as more or less planar waves, causing at distant acoustical to electrical input converters time delays which are far predominantly caused by the direction of arrival with which such signals impinge upon the converter. As known to the skilled artisan, this time delay is used in beamformer art, whereby a delayed output signal from one converter is subtracted from the output signal of the other converter. There results at the common output of subtraction a signal which has an amplification characteristic with respect to impinging acoustical signals which is dependent on the direction of arrival DOA of such signals with respect to the converters and is commonly known as beamformer characteristics.

The subtraction of well correlated signals as generated by the above mentioned normal signals to be perceived as of speech or music signals normally leads to the known roll-off behavior of such beamformers. The roll-off behavior or characteristic establishes a frequency dependent attenuation of the beam characteristics. It has a pronounced high-pass character, which considerably attenuates low frequencies which are critical especially for speech perception.

Wind noise signals are not subject to the roll-off behavior of a beamformer because of their lower correlation even at very low frequencies and considered at least two spaced apart input converters. Whereas normal signals as speech is attenuated by the roll-off towards low frequencies, wind noise is not. Even worse, wind noise has a further adverse effect on signal transfer of normal signals affecting speech recognition. It masks speech-caused signals due to the "upwards-spread-off masking". Upward-spread-off masking is a phenomenon according to which a signal at a predetermined spectral frequency masks signals at higher frequency increasingly with increasing amplitude.

From the US 2002-0 037 088 A1 as well as from the DE 10 045 197 it is known to tackle the problem of wind noise by detecting such noise at two spaced-apart input converters and use in windy situations only the output signal of one of the omnidirectional converters, thereby in fact switching beamforming off. Further, a static high-pass filter is switched on to further attenuate wind noise.

Nevertheless, many hearing devices do not feature two or more acoustical input converters, so that the detection and elimination of wind noise based on two or more converters is not always possible. Further, as was mentioned above, the spectral shape of wind noise varies significantly in time. Thereby, the spectrum range, where wind noise has an energy i.e. below $10^4$ Hz is exactly that range where a hearing device should be effective, because individuals have often impaired hearing abilities in this range. Attenuating wind noise with a static high-pass filter will either filter too little of the wind noise to maintain normal signal perception, or to such an amount that wind noise is well cancelled, but also normal acoustical signals to be perceived. Switching beamforming off as proposed in the above mentioned documents significantly reduces the overall advantages of a hearing device with beamforming abilities also at higher frequencies.

It is an object of the present invention generically to provide methods and devices which deal with the above mentioned drawbacks. Although it departs from the specific wind noise problems, some of the solutions according to the present invention may also be applied for improving signal-to-noise ratio more generically with respect to normal acoustical signals as of speech or music signals or for improving beamformer control and/or wind detection.

BRIEF SUMMARY OF THE INVENTION

Detailed theoretical considerations to the different aspects of the present invention may be found in the paper from F. Pfisterer for achieving their diploma at the Federal Institute of Technology in Zurich. The paper by F. Pfisterer, which is titled "Wind Noise Canceling for Hearing Instruments," was filed as an appendix in application Ser. No. 10/378,453, which this application is a divisional of and is incorporated herein by reference.

$1^{st}$ Aspect

Under a first aspect of the present invention the above mentioned object is resolved by manufacturing a specifically tailored hearing device. There is proposed a method for manufacturing such a hearing device which comprises the steps of:

- providing in a hearing device casing an acoustical/electrical input converter arrangement with an electric output;
- providing an audio signal processing unit for establishing audio signal processing of the device according to individuals' needs and/or purposes of the device, having an input and an output;

providing at least one electrical/mechanical output converter with an input characteristic and with a control input for the characteristic, further having an input and an output, and establishing the following operational connections:

between the output of the input converter arrangement and the input of the filter arrangement, between the output of the filter arrangement and the control input, between the output of the filter arrangement and the input of the processing unit, between the output of the processing unit and the input of said at least one output converter.

Thereby, establishing the operational connections as mentioned needs clearly not be performed in a time sequence according the sequence of above wording. The operational connections may at least in part be established between units before they are assembled. Further, it must be emphasized that the output signal of the filter arrangement is just an improved "picture" of the acoustical signals, specific signal processing as for hearing aid devices is performed downstream the filter arrangement.

By this method there is provided a hearing device at which the high-pass characteristic is adapted to the acoustical situation.

In a most preferred embodiment of this method, the step of establishing operational connection of the output of the filter arrangement to the control input of the high-pass filter is performed via a statistics evaluating unit.

Definition

By the term "statistics evaluation unit" we understand a unit at which the behavior of the input signal is continuously monitored during a predetermined amount of time and there is formed over time a statistical criterion of such signal. Generically the output signal of the statistic-forming unit reacts with a time lag on momentarily prevailing characteristics of the input signal and has thus, generalized, a low-pass characteristic. In fact and as example such statistics-forming and evaluating unit may include LMS-type algorithms (Least Means Square) or other algorithms like Recursive Least Square (RLS) or Normalized Least Means Square (NLMS) algorithms.

In a proposed preferred embodiment the statistics-evaluating unit as provided determines the amount of energy of the signal fed to its input and being indicative of the energy at the output of the filter arrangement. Adjusting the high-pass filter characteristic is performed so as to minimize such energy. Thereby preferably one of the algorithms mentioned above is applied. By adjusting the high-pass characteristic, the cut-off frequency or frequencies and/or attenuation slope or slopes and/or low frequency attenuation may be adjustable. In a further embodiment the statistics forming and evaluation unit may estimate speech intelligibility of the output signal of the filter arrangement e.g. by computing the known speech intelligibility index or may estimate speech quality e.g. by computing segmental SNR.

In a far preferred embodiment of this method of manufacturing a hearing device the addressed high-pass filter arrangement is realized with a predictor unit, thereby preferably in that there is operationally connected to the output of the input converter arrangement a unit with a predictor unit in the following structure:

an adjustable low-pass filter is provided with an input operationally connected to the output of the input converter arrangement and with an output operationally connected to one input of a comparing unit;

there is operationally connected the output of the input converter arrangement substantially unfiltered with respect to frequency to a second input of the comparing unit;

finally the output of the comparing unit is operationally connected to a control input of the low-pass filter for adjusting the characteristic of the low-pass filter. The control input of the low-pass filter establishes the control input of the high-pass filter arrangement, the output of the comparing unit is in fact the output of the high-pass filter arrangement.

In fact by means of the low-pass filter—with a preceding delay unit—there is established prediction of evolution of the filter input signal. By comparing the output signal of the low-pass filter with the instantaneously prevailing unfiltered signal, principally as occurring at the output of the input converter arrangement, there results a prediction difference between actual signal and predicted signal. As in a most preferred embodiment the low-pass filter is controlled from the output of the comparing unit via statistics evaluation unit, thus with a relatively long reaction time, the low-pass filter may be adjusted to minimize the difference of prediction and actual signal, nevertheless substantially maintaining the spectrum of acoustical normal signals as of speech and music substantially less attenuated. By means of high-pass filter characteristic adjustment the device manufactured becomes optimally adapted to time-varying wind situations.

In a further most preferred embodiment which is especially applied in combination with the above mentioned predictor technique there is provided an analog to digital conversion unit, which is operationally connected at its input side to the output of the input converter arrangement and operationally connected at its output side to the input of the addressed high-pass filter arrangement. Thereby, the said filter arrangement is construed as a digital filter arrangement.

A hearing device, which resolves the above mentioned object comprises a processor unit for establishing signal processing of the device according to individual needs and/or purpose of the device and has an input and an output. There is further provided at least one, for binaural devices two output electrical/mechanical converters with an output; further there is provided an acoustical/electrical input converter arrangement, a filter arrangement with adjustable high-pass characteristics. The input of the filter arrangement is operationally connected to an output of the input converter arrangement, which has a control input for adjusting the characteristic. The control input is operationally connected to the output of the filter arrangement, which is further operationally connected to the output converter via the processing unit.

Further preferred embodiments of such device are disclosed in the claims and the detailed description. Under the first aspect of the present invention the above mentioned object is resolved by the method of reducing disturbances, especially wind disturbances, in a hearing device with an input acoustical/electrical converter arrangement, which generates a first electric output signal. Such method comprises the steps of filtering a signal which is dependent from the first electric signal with a variable high-pass characteristic so as to generate a second electric signal and by adjusting the variable characteristic of the high-pass filter by a third signal which is derived or dependent on the second signal. In a preferred mode generating the third signal in dependency of the second signal, includes performing a statistical evaluation on the second signal, and the third signal is generated in dependency of the result of the statistical evaluation. Thereby, in a still further preferred embodiment the energy of the second signal is evaluated and adjusting of the high-pass characteristic is performed so as to minimize this energy.

In a most preferred embodiment filtering is realized by predicting and forming a difference from a prediction result and an actual signal, whereby such difference is minimized by appropriately adjusting the filter characteristics. Further, in a preferred form of realizing the method it comprises the steps of

- low-pass filtering a signal dependent on the output signal of the input converter arrangement with an adjustable low-pass characteristic;
- comparing a signal dependent on the result of the low-pass filtering with a signal dependent from the output of the input converter substantially unfiltered with respect to its frequency content, and
- controlling the adjustable high-pass characteristic by controlling the adjustable low-pass characteristic.

Most preferably and especially in the last mentioned realization form, filtering and adjusting is performed digitally. By the methods and the device according to the present invention under its first aspect as outlined above, irrespective whether an input acoustical/electrical converter arrangement has one or more than one acoustical/electrical input converters, wind noise is substantially canceled adaptively to the prevailing wind noise situation. Thereby, the signal components to be perceived as resulting from speech or music are substantially less attenuated than wind noise components. Whenever statistic forming and evaluation is performed on basis of a correlation, in a preferred embodiment the statistics forming and evaluation unit has a further input which is operationally connected to the input of the filter arrangement.

$2^{nd}$ Aspect

Under a second aspect the present invention deals most generically with improving signal-to-noise ratio at a hearing device. Thereby, and as will be explained under this second aspect this part of the invention is most suited to reestablish improved signal-to-noise ratio with respect to wind noise after a signal has been processed by high-pass filtering as was explained under the first aspect of the invention.

$1^{st}$ Sub-Aspect

Definition

We understand under a "pitch" spectral peaks or peaks of narrow band-width.

The fundamental and the spectral harmonics of a signal represent such "pitches". A pitch-filter is comb-filter with a multitude of narrow pass-bands. It covers for a signal with fundamental and harmonic spectral lines all predominant lines or a predetermined number thereof with pass-bands.

Under a first sub-aspect of the present invention there is provided a method for manufacturing a hearing device, which comprises the steps of

- providing in a hearing device casing an acoustical/electrical input converter arrangement with an electric output;
- providing a pitch filter with adjustable pitch position and with a control input for the pitch position and further with an input and with an output;
- providing a pitch detector arrangement with an input and with an output, and
- establishing operational connection between the electric output of the input converter arrangement and the input of the pitch filter and between the output of the input converter arrangement and the input of the pitch detector arrangement, and further between the output of the pitch detector arrangement and the control input at the pitch filter.

We draw the attention on the WO 01/47335 with respect to pitch filter appliance, which accords with U.S. application Ser. No. 09/832,587.

Generically by means of the pitch detector discrete frequency components in the signals output from the input converter arrangement are detected and their specific frequencies monitored. By controlling pitch position of the pitch filter, i.e. spectral position of its pass-bands, to track the frequencies as monitored, SNR of pitches to noise in the processed signal is improved. Thereby, such pitch signal components are amplified relative to the spectrally intermediate noise.

It has to be emphasized again that establishing the operational connection in the method of manufacturing the hearing device with the pitch filter may be done at least in part well in advance of assembling the units to form the device whenever pitch detection is to be performed by a recursive method, in a preferred embodiment a further input of the pitch detector is operationally connected to the output of the pitch filter.

Under this first sub-aspect there is further provided a hearing device, which comprises

- an acoustical/electrical input converter arrangement with an output;
- a pitch filter with adjustable pitch position and a control input for said pitch position, further having an input and an output;
- a pitch detector unit with an input and with an output, whereby the output of the input converter arrangement is operationally connected to the input of the pitch filter, the output of the input converter arrangement is further operationally connected to the input of the pitch detector unit, and the output of the pitch detector unit is operationally connected to the control input at the pitch filter.

There is further provided a method for improving signal-to-noise ratio in a hearing device, which comprises pitch filtering a first signal dependent from an output signal of an acoustical/electrical input converter arrangement, monitoring the actual pitch frequencies of predominant frequency components within the first signal and adjusting the pitch position of the pitch filtering dependent on the actual pitch frequency positions as monitored.

As was already mentioned above, by the technique according to the present invention under its first aspect the signal components to be improved as resulting from speech or music may be attenuated to some extent by high-pass filtering. By combining the present invention under the just addressed 1st sub-aspects with the invention according to the first aspect SNR with respect to wind noise is further improved. This is realized by first operating or performing the invention with adjustable high-pass filtering upon a signal dependent from the output signal of the input converter arrangement and operating on a signal dependent on the output signal of such high-pass filtering the technique according to the just addressed $1^{st}$ sub-aspect, namely of pitch filtering with controllably adjustable pitch frequency position.

$2^{nd}$ Sub-Aspect

Under the second aspect of the present invention and thereby under a second sub-aspect thereof there is provided improved SNR ratio especially with respect to speech signals.

With respect to spectrum, one characteristic of speech signals is that the fundamental is approximately between 50 Hz and 1 kHz.

Under this second sub-aspect there is provided a method for manufacturing a hearing device comprising:

- providing in a hearing device casing an acoustical/electrical input converter arrangement with an electric output;
- providing an adding unit with at least two inputs;

providing a first band pass filter unit with an input and with an output and with a band selected to pass selected harmonics of speech;

a non-linear modulation unit with an input and with an output;

a second band pass filter unit or a low-pass filter unit with an input and with an output and with a pass-band selected on a different harmonics of speech, and establishing the following operational connections:

from the output of the input converter arrangement to one input of the adding unit without substantial frequency filtering;

from the output of the input converter arrangement to the input of the first band pass filter unit without substantial frequency filtering;

from the output of the first band pass filter unit to the input of the non-linear modulation unit and from the output of the non-linear modulation unit to the input of the second band pass or low-pass filter unit and finally from the output of the second band pass or low-pass filter unit to the second input of the adding unit.

By manufacturing a hearing device as stated the following is realized:

On the output signal of the input converter arrangement speech signals shall be present also and especially with their fundamental components. Due to band-restricted noise as e.g. and especially wind noise, SNR greatly varies considered along the pitches of speech. By selecting at the first band pass filter unit a pass-band according to a harmonics of speech at which a good SNR prevails and subjecting such band filtered signal to a non-linear modulation, all harmonics are regenerated with good SNR. From all the harmonics generated by the non-linear modulation one or more than one band is selected by respective one or more than one second band pass filters or a low-pass filter. The resulting, remaining selected harmonics may first be amplified if desired and are added to the original fundamental and/or harmonics. Thus, in the resulting signal pitches of speech with originally low SNR are improved with respect to that SNR.

In a preferred mode of the manufacturing method under this second sub-aspect, an analog to digital conversion unit is provided with an input and with an output, and there is established the operational connection between the output of the input converter arrangement and the one input of the adding unit as well as to the input of the first band pass filter via such analog to digital conversion unit. Thereby, the filter units, the non-linear modulation unit and the adding unit are realized as digital units.

Still under the second sub-aspect of the second aspect of the present invention there is further proposed a hearing device which comprises an acoustical/electrical input converter arrangement with an output, a first band pass filter unit with an input and with an output and with a band selected to pass selected harmonics of speech, a non-linear modulation unit with an input and with an output, a second band-pass filter or low-pass filter unit selected to pass different selected harmonics having an input and an output. There is further provided an adding unit with two inputs and with an output. The output of the input converter arrangement is operationally connected to a first input of the adding unit, substantially without frequency filtering, the output of the input converter arrangement is further operationally connected to the input of the first band pass filter unit, whereby the output of that unit is operationally connected to the input of the non-linear modulation unit. The output of the non-linear modulation unit is operationally connected to the input of the second band pass filter or of the low-pass filter unit, the output of which being operationally connected to the second input of the adding unit.

Again, preferred embodiment of that device are disclosed in the claims and the specific description.

Under this second sub-aspect there is further proposed a method for increasing signal-to-noise ratio at a hearing device and especially with respect to speech signals with an acoustical/electrical input converter generating a first electric signal, which comprises the steps of band pass filtering a signal dependent on said first signal to generate a band pass filtered signal with harmonic components of speech;

modulating said filtered signal at a non-linear characteristic to generate an output signal with a re-increased number of harmonic components of speech;

band- or low-pass filtering said output signal with said re-increased number of harmonic components to generate a further signal with selected harmonic components and superposing said further signal to a signal dependent on said first electric signal.

Again the techniques according to this second sub-aspect of the present invention are ideally suited to be combined with the technique as taught under the first aspect of the present invention as disclosed in the claims and the detailed description.

3$^{rd}$ Aspect

As was mentioned above prior art electronic approaches to quit with wind noise at hearing devices with beamforming ability disable such ability whenever wind noise is too large.

Under the third aspect of the present invention a technique is proposed on one hand to substantially cancel wind noise and on the other hand to substantially maintain beamforming ability.

According to the invention under the third aspect there is proposed a method of manufacturing an acoustical device, especially a hearing device, which comprises the steps of providing in a device casing an acoustical/electrical input converter arrangement generating at an output an electrical signal in frequency or frequency band domain with a beamformer amplification characteristic of acoustical signals impinging on said arrangement in dependency of impinging angle with which the acoustical signals impinge thereon and with a predetermined frequency roll-off characteristic of the beamformer characteristic.

There is further provided a normalizing unit with in input and with an output and there is established an operational connection of the output of the converter arrangement and the input of the normalizing unit. Further, there is provided a memory unit with the predetermined roll-off characteristic stored therein. Still further, there is provided a comparing unit.

There is established an operational connection between the output of the normalizing unit and one input of the comparing unit as well as between the output of the storing unit and the second input of the comparing unit.

There is additionally provided a controlled selection unit with a control input, an input as well as an output and there is established an operational connection between the output of the converter arrangement and the input of the selection unit as well as between the output of the comparing unit and the control input of the selection unit. The selection unit is controlled to attenuate frequency components of the electric signal input to its output, the normalized values of which non-resulting in a predetermined comparison result at the comparing unit differently than such components for which said comparison does result in the predetermined result.

Although it is absolutely possible to provide an acoustical/electrical input converter arrangement with a single acoustical/electrical input converter as of a directional microphone with an intrinsic beamformer characteristic, also in this case it is preferred to provide at the input converter arrangement at least one second acoustical/electrical input converter.

This is clearly also the case if the beamformer characteristic is generated, as known, on the basis of the output signals of two or more than two distinct acoustical/electrical converters.

Therefore, in a most preferred embodiment of this method, the input converter arrangement as provided has at least two input acoustical/electrical converters.

Whenever an input converter arrangement is provided with at least two acoustical/electrical converters, in a most preferred embodiment the input arrangement is provided with at least two time domain to frequency or to frequency band domain conversion units. One of these conversion units is operationally connected to one of the at least two input converters, the second one of these conversion units to a second one of the at least two input converters. Thereby, in fact before beamforming-processing of the output signals of the at least two input converters, the output signals of these input converters are time domain to frequency or frequency band domain converted.

On the other hand whenever beamforming is performed intrinsically by an input converter with directional characteristic, the output signal of that converter as well as the output signal of a further input converter is time domain to frequency or frequency band domain converted.

In a further preferred embodiment there is provided the beamformer unit with a control input and there is established an operational connection between the output of the comparing unit and the control input of the beamformer unit.

By establishing an operational control connection between the output of the comparing unit and a control input of the beamformer unit it becomes possible to selectively control the beamforming ability of the beamformer unit according to evaluation of the comparing results as mentioned above.

Further, in a preferred embodiment and whenever the input converter arrangement as provided has at least two input acoustical/electrical converters there is established an operational connection between an output of one of these at least two input converters via a further output of the input converter arrangement, and a further input of the normalizing unit for receiving there a normalizing signal.

In a further preferred mode thereof there is interconnected between the output of the said one input converter the further input of the normalizing unit, a time domain to frequency or frequency band domain conversion unit, so that the normalizing signal applied to the further input of the normalizing unit is in frequency or frequency band domain. Thus, normalizing signals are applied frequency- or frequency band-specifically.

In a further preferred mode, varying attenuation at the selection unit is performed softly. It is preferred not to binaurally switch from maximum attenuation, e.g. leading to zero level, to minimum attenuation e.g. leading to maximum level. Therefore, in a further preferred embodiment there is provided a signal transfer unit with a low-pass-type signal transfer between its input and output, and the operational connection between the output of the comparing unit and the control input of the selection unit is provided via such signal transfer unit. At the selection unit, preferably, frequency or frequency band-specific attenuation is adjustable continuously of substantially continuously as in small steps, controlled by the control signals.

In a most preferred embodiment for manufacturing a hearing device at which wind noise is optimally canceled the predetermined result established is when said normalized values are at most equal to roll-off characteristic values at the respective frequencies considered. There is thus checked, whether the normalized beamformer output signals at the specific frequency is at most equal to the value of the roll-off characteristic at that frequency, and if it is this frequency component is passed to the output by the selection unit, if it is not the respective component becomes attenuated.

Accordingly there is provided under this third aspect of the invention, an acoustical, thereby especially a hearing device which comprises an input acoustical/electrical converter arrangement, which has an output and generates an output signal thereat with a beamformer amplification characteristic having a predetermined frequency roll-off characteristic. This output signal is in the frequency or in the frequency band domain. There is further provided a normalizing unit with an input which is operationally connected to the output of the input converter arrangement and with an output which is operationally connected to one input of a comparing unit. There is further provided a memory unit with a predetermined roll-off characteristic stored therein, an output of which being operationally connected to a second input of the comparing unit. A control selection unit with a control input and a signal input operationally connected to the output of the input converter arrangement has its control input operationally connected to the output of the comparing unit, thereby controllably attenuating frequency components in a signal input to a signal output, for which comparison has not shown up a predetermined result, thereby performing said attenuating differently than upon components for which the comparison result has affirmatively resulted in the predetermined result.

Preferred embodiments of such device are disclosed in the claims as well as in the detailed description.

Under this third aspect there is further provided a method for at least substantially canceling wind disturbances in an acoustical device, thereby especially in a hearing device, which has an input acoustical/electrical converter arrangement, which generates at an output an electric signal in frequency or in frequency band domain with a beamformer amplification characteristic with respect to impinging angle with which acoustical signals impinge upon the arrangement and with a predetermined frequency roll-off characteristic. The method comprises the steps of normalizing a signal which depends on the electric signal in frequency or frequency band domain, comparing frequency or frequency band specifically the normalized signals with respective values of the frequency roll-off characteristic and attenuating frequency signal components of the electrical signal in dependency of the results of the comparing operation.

Here too, preferred embodiments of this method are disclosed in the claims as well as in the detailed description.

According to the invention under the third aspect there is proposed a method of manufacturing an acoustical device, especially a hearing device, comprising the steps of providing in a device casing an acoustical/electrical input converter arrangement, generating at an output an electrical signal in frequency or frequency band domain with a beamformer amplification characteristic of acoustical signals impinging on said arrangement in dependency of impinging angle with which said acoustical signals impinge thereon and with a predetermined frequency roll-off characteristic of said beamformer characteristic;

providing a normalizing unit with an input and with an output and establishing operational connection of said output of said arrangement and said input of said normalizing unit;

providing a memory unit with said predetermined roll-off characteristic stored therein;

providing a comparing unit;

establishing operational connection between the output of said normalizing unit and one input of said comparing unit as well as between said output of said storing unit and a second input of said comparing unit;

providing a controlled selection unit with a control input, an input and an output and establishing an operational connection between said output of said arrangement and said input of said selection unit as well as between said output of said comparing unit and said control input of said selection unit, said selection unit being controlled to alternate frequency components of said electric signal to its output, the normalized values of which non resulting in a predetermined comparison result at said comparing unit.

There is further provided the step of providing the input converter arrangement with at least two input acoustical/electrical converters.

There is further provided at least two time domain to frequency or frequency band domain conversion units—TFC—each with an input and an output and establishing an operational connection of a first of said at least two input converters with the input of a first of said at least two TFC converter units and of a second of said at least two input converters with the input of a second of said at least two TFC converter units.

There is further provided the step of providing said beamformer characteristic by providing a beamformer unit with at least two inputs and establishing a first operational connection between an output of a first of said at least two input converters and a first of said at least two inputs of said beamformer unit and a second operational connection between an output of a second of said at least two input converters and a second of said at least two inputs of said beamformer unit.

There is further provided at least two time domain to frequency or frequency band domain conversion—TFC—units and establishing said first and second operational connections each via one of said at least two TFC units.

There is further provided said beamformer unit with a control input and establishing an operational connection between the output of said comparing unit and said control input of said beamformer unit.

There is further provided the step of providing said input converter arrangement with a further output and establishing an operational connection between an output of one of said at least two input converters and said further output and between said further output and a further input of said normalising unit for a normalising signal.

There is further provided said input converter arrangement with said further output providing a output signal in frequency or frequency band domain.

There is further provided a signal transfer unit with a low-pass type signal transfer between an input and an output and operationally interconnecting said signal transfer unit between said output of said comparing unit and said control input of said selection unit.

There is further provided the step of establishing said predetermined result as said normalized values being at most equal to said predetermined roll-off characteristic values at the frequencies considered.

Under this third aspect, there is further provided an acoustical device especially a hearing device comprising an input acoustical/electrical converter arrangement having an output and generating an output signal at said output with a beamformer amplification characteristic dependent on the direction with which acoustical signals impinge upon said arrangement and having a predetermined frequency roll-off characteristic of said beamformer characteristic and further being in the frequency or frequency band domain, a normalizing unit, an input of which being operationally connected to the output of said arrangement, an output of which being operationally connected to one input of a comparing unit;

a memory unit with said predetermined roll-off characteristic stored therein, an output of which being operationally connected to a second input of said comparing unit;

a controlled selection unit with a control input and an input operationally connected to the output of said arrangement, said control input of said selection unit being operationally connected to said output of said comparing unit, said selection unit controllably attenuating frequency components in a signal input to a signal output for which comparison has not resulted in a predetermined result, differently than such components for which said comparison has resulted in said predetermined result.

There is further provided said input converter arrangement comprising at least two input acoustical/electrical converters, each with an output.

There is further provided at least two time domain to frequency or frequency band domain conversion units TFC, each with an input and with an output, the output of a first of said at least two input converters being operationally connected to the input of a first of said TFC units, the output of a second of said input converters being operationally connected to the input of a second of said TFC units.

There is further provided a beamformer unit with at least two inputs, one input thereof being operationally connected to an output of one of said at least two input converters the other input thereof being operationally connected to an output of a second of said at least two input converters.

There is further provided at least two TFC units, one operationally interconnected between said one input of said beamformer unit and said output of said first input converter the second operationally interconnected between said input of said second TFC unit and said output of said second input converter.

There is further provided said beamformer unit comprising a control input being operationally connected to the output of said comparing unit.

There is further provided wherein said comparison results act upon said attenuating with a low-pass-type transfer function.

There is further provided said arrangement comprising a further output operationally connected to an output of one of said at least two input converters, said output being operationally connected to a further input of said normalizing unit for a normalizing signal.

There is further provided wherein said predetermined result is that said normalized value is at most equal to said predetermined roll-off characteristic value.

Additionally, under this third aspect there is provided a method for at least substantially canceling wind disturbances in a acoustical device especially in a hearing device with an input acoustical/electrical converter arrangement, said arrangement generating at an output an electric signal in frequency or frequency band domain with a beamformer amplification characteristic with respect to the impinging angle with which acoustical signals impinge upon said arrangement and with a predetermined frequency roll-off characteristic comprising the steps of normalizing a signal dependent on said electric signal in frequency domain, comparing frequency- or frequency band-specifically said normalized signals with said respective values of said frequency roll-off characteristic and attenuating frequency signal components of said electric signal in dependency of results of said comparing.

There is further provided the step of frequency selectively normalising said signal dependent on said electric signal by signal values which depend from values of respective frequency components of said impinging acoustical signal by a predetermined, frequency independent factor.

There is further provided the step of generating said beamformer characteristic by at least two input acoustical/electrical converters in said input converter arrangement.

There is further provided the step of generating said values by an input acoustical/electrical converter at said input converter arrangement.

There is further provided establishing dependency of said attenuating from said results with a low-pass type dependency.

There is further provided a method thereby selecting said comparing as determining whether said normalised signals are or are not at least equal to respective values of said predetermined roll-off characteristic and selecting said attenuation to be the larger for signals for which comparison result is of affirmative or negative.

There is further provided frequency selectively attenuating beamforming in dependency of said results.

There is further provided establishing said dependency with a low-pass-type characteristic.

$4^{th}$ Aspect

As was mentioned above in prior art attempts wind noise canceling was established in hearing devices with beamforming abilities just by switching off such beamformer ability and going on by processing acoustical signals substantially based on an omnidirectional characteristic.

Under the present fourth aspect an approach has been invented, according to which the beamformer ability is only attenuated up to complete switch off at those frequencies or frequency bands, where significant disturbances are present. More generically, nevertheless departing from the above mentioned wind noise canceling problem, a technique is proposed, by which beamforming abilities at an acoustical device may frequency or frequency band selectively be reduced up to switching such beamforming ability off.

A method of manufacturing a beamforming device, thereby especially an acoustical device and even more specifically a hearing device, comprises providing in a casing of the device a beamformer unit which operates in frequency or in frequency band domain. At such beamformer unit there is provided a control input, which frequency or frequency band selectively controls beamforming of the beamformer unit. There is further provided a control unit which has an output for frequency or frequency band selective control signals, and there is established an operational connection between the output of the control unit and the said control input.

With an eye on specific noise canceling purposes the method comprises providing the control unit with a frequency or frequency band selective noise detector.

Thereby, with an eye on wind noise handling, the control unit is provided having a wind noise detector. Thereby, it must be established that wind noise is in fact a band-specific noise, which is detected by a respectively tailored frequency- or frequency band-selective noise detector.

In a most preferred mode there is provided the beamformer unit with at least two input converters, each having an output. There is further provided at least one controlled frequency- or frequency band-specific attenuation unit with a frequency or frequency band selective attenuation control input, further with an input and an output. For beamforming there is further provided a beamformer processing unit, which has at least two inputs and an output.

Operational connections are established between an output of one input converter via the attenuation unit to one input of the processing unit. Thereby, clearly both outputs of the at least two input converters may be operationally connected to the inputs of the processing unit via such an attenuation unit.

In any case there is established an operational connection between the output of a second input converter and the second input of the processing unit. Further, an operational connection is established between the output of the control unit and the control input of the attenuation unit.

Under this fourth aspect of the present invention there is further proposed a beamforming device, preferably an acoustical device, most preferably a hearing device, which comprises a beamformer unit, which is operating in frequency or frequency band domain, and which has a control input for frequency or frequency band selectively controlling beamforming. There is further provided a control unit, which has an output for frequency- or frequency band-specific control signals, which is operationally connected to the said control input.

Preferred embodiments of such method and device are disclosed in the claims as well as in the detailed description.

Still under the fourth aspect of the present invention it is proposed a method for controlling beamforming—especially for acoustical appliances, thereby most preferably for hearing device appliances—which method comprises performing beamforming in frequency or frequency band domain and controlling beamforming frequency- or frequency band-selectively.

Again preferred embodiments of this method are disclosed in the claims as well as in the detailed description.

The invention under the presently discussed fourth aspect, namely of selectively controlling beamforming, may and is preferably used and applied when realizing the present invention under its third aspect:

According to the third aspect, spectral components of a signal are determined and selected (comparison with roll-off characteristic) which are more noise disturbed than others. Once such selection has been made, the same selection may be applied to the presently proposed frequency or frequency band selective attenuation of beamforming. In such a combination not only that selected frequency of frequency band components are attenuated with a preferred slowly varying attenuation, but additionally beamforming in frequencies or frequency bands of those components is, preferably steadily or slowly, attenuated, resulting finally and for those specific frequency or frequency bands considered, in beamforming being switched off, thereby transiting to omnidirectional amplification characteristic for those frequencies or frequency bands.

Under the fourth aspect, there is provided a method of manufacturing a beamforming device comprising:

- providing in a casing of said device a beamformer unit operating in frequency or frequency band domain
- providing at said beamformer unit a control input frequency or frequency band selectively controlling beamforming of said beamformer unit
- providing a control unit having an output for frequency or frequency band selective control signals and establishing an operational connection between the output of said control unit and said control input.

There is further provided the step of providing said control unit with a frequency or frequency band selective noise detector.

There is further provided the step of providing said control unit with a wind-noise detector and said beamformer unit with an acoustical/electrical converter arrangement.

There is further provided the step of providing said beamformer unit with at least two input converters each having an output;

providing at least one controlled frequency of frequency band selective attenuation unit with a frequency or frequency band selective attenuation control input, an input and an output providing a beamformer processing unit with at least two inputs and an output establishing operational connections between:

an output of one input converter via said attenuation unit to one input of said processing unit an output of a second input converter to a second input of said processing unit said output of said control unit and said control input of said attenuation unit.

There is further provided said beamforming device being an acoustical device, especially a hearing device.

Under this fourth aspect of the present invention there is further proposed a beamforming device comprising a beamformer unit operating in frequency or frequency band domain and having a control input for frequency or frequency band selectively controlling beamforming a control unit having an output for frequency or frequency band selective control signals being operationally connected to said control input.

There is further provided a frequency or frequency band selective noise detector.

There is further provided a wind noise detector and said device being an acoustical/electrical beamforming device.

There is further provided at least two input converters each with an output and a beamformer processing unit with at least two inputs and an output at least one controlled frequency or frequency band selective attenuation unit with a frequency or frequency band selective attenuation control input and an output said output of one of said input converters being operationally connected to one input of said processing unit via said attenuation unit, said output of a second of said input converters being operationally connected to a second input of said processing unit, said output of said control unit being operationally connected to said control input of said alternation unit.

There is further provided the device being an acoustical device, especially a hearing device.

There is further provided steps of performing beamforming in frequency or frequency band domain, controlling beamforming frequency or frequency band selectively.

There is further provided the step of controlling beamforming in dependency of frequency or frequency band specific disturbances.

There is further provided said beamforming being an acoustical/electrical beamforming and controlling said beamforming in dependency of prevailing wind noise.

There is further provided the method for controlling acoustical/electrical beamforming especially of a hearing device.

There is further provided the method comprising the step of performing said beamforming by processing output signals of at least two input converters in frequency or frequency band domain and applying a controllable, frequency or frequency band specific attenuation to at least one of said output signals in said domain.

$5^{th}$ Aspect

As the skilled artisan is perfectly aware of, it is a need in acoustical devices and especially hearing devices to detect whether wind noise is present to a higher amount than desired so as to take appropriate measures in controlling such device. This is true for such devices irrespective whether their input acoustical/electrical converter arrangement is based on acoustical signal reception by means of one single acoustical/electrical input converter or by means of more than one such input converters, as for two or more converter beamforming.

Under this fifth aspect the present invention proposes a novel and most advantageous wind noise detection technique, which may be applied especially irrespective of the concept of the input converter arrangement with respect to number of acoustical/electrical converters.

This object is resolved by a method of manufacturing an acoustical device, which comprises providing an acoustical/electrical input converter arrangement into a casing of the device, whereby the arrangement has an output. There is further provided a calculation unit, which has an input and an output. Operational connection is established between the output of the converter arrangement and the input of the calculating unit.

The calculation unit is programmed to calculate from a signal input the frequency coordinate values of the balance point of a surface defined by the spectrum of the said signal in a predetermined frequency range. The calculating unit thereby generates an output signal in dependency of the said coordinate value, which is indicative of wind noise.

In a most preferred embodiment the calculation unit as provided is programmed to continuously average the coordinate values of the addressed balance point over a predetermined amount of time and/or to continuously calculate the variance of the coordinate value over a predetermined amount of time. Thereby, preferably generating of the output signal comprises generating such signal at least in dependency of such averaging and/or the said variance.

Preferred embodiments of this method are disclosed in the claims as well as in the detailed description.

Under this fifth aspect of the invention there is further proposed an acoustical device, which comprises an acoustical/electrical input converter arrangement with an output, a calculation unit with an input being operationally connected to the output of the converter arrangement. The calculation unit is programmed to calculate from an input signal the frequency coordinate value of the balance point of a surface of the spectrum in a predetermined frequency range. The calculation unit further generates an output signal in dependency of the found coordinate value, which output signal is indicative of wind noise.

Preferred embodiments of this device are disclosed in the claims as well as in the detailed description.

There is further proposed under this fifth aspect of the present invention a method of detecting wind noise at an acoustical device with acoustical/electrical conversion to generate an electric signal. Such method comprises the step of electronically calculating the frequency coordinate value of the balance point of the spectrum of the signal within a predetermined frequency range and generating a wind noise indicative signal in dependency of this value.

Preferred embodiments of this method are apparent to the skilled artisan from its disclosure in the claims as well as the detailed description.

Under this fifth aspect of the invention there is further proposed a method of manufacturing an acoustical device comprising providing a acoustical/electrical input converter arrangement into a casing of the device said arrangement having an output providing a calculation unit with an input and an output establishing an operational connection between said output of said converter arrangement and said input of said calculation unit programming said calculation unit to calculate from a signal input the frequency-coordinate value of the balance point of a surface of the spectrum in a predetermined frequency range and generating an output signal in dependency of said coordinate value indicative of wind noise.

There is further provided programming said unit to continuously average said coordinate value over a predetermined amount of time and/or to continuously calculate the variance of said coordinate value over a predetermined amount of time, generating said output signal comprising generating said output signal at least in dependency of said average and/or said variance.

There is further provided said device being a hearing device.

There is further provided an acoustical device comprising an acoustical/electrical input converter arrangement with an output, a calculation unit with an input operationally connected to said output and being programmed to calculate from a input signal at said input the frequency-coordinate value of the balance point of a surface of the spectrum in a predetermined frequency range and to generate an output signal in dependency of said coordinate value indicative of wind noise.

There is further provided said calculation unit being further programmed to continuously calculate average value of said coordinate value over a predetermined amount of time and/or the variance of said coordinate value over a predetermined amount of time, generating said output signal comprising generating said output signal in dependency of at least at least one of said average and said variance.

There is further provided the device being a hearing device.

There is further provided a method of detecting wind noise at an acoustical device with acoustical/electrical conversion to generate an electric signal comprising the steps of electronically calculating the frequency coordinate value of the balance point of the spectrum of said signal within a predetermined frequency range and generating a wind noise indicative signal in dependency of said value.

There is further provided the method further comprising continuously calculating an average value over a predetermined amount of time of said coordinate value and/or variance of said coordinate value over a predetermined amount of time and generating said wind noise indicative signal in dependency at least of at least one of said average value and of said variance.

There is further provided the device of said method being a hearing device.

BRIEF DESCRIPTION OF THE SEVERAL VIEWS OF THE DRAWINGS

The invention shall now be described in more details and referring to examples and with the help of figures.

The figures show by examples.

DETAILED DESCRIPTION OF THE INVENTION

Figure 1:
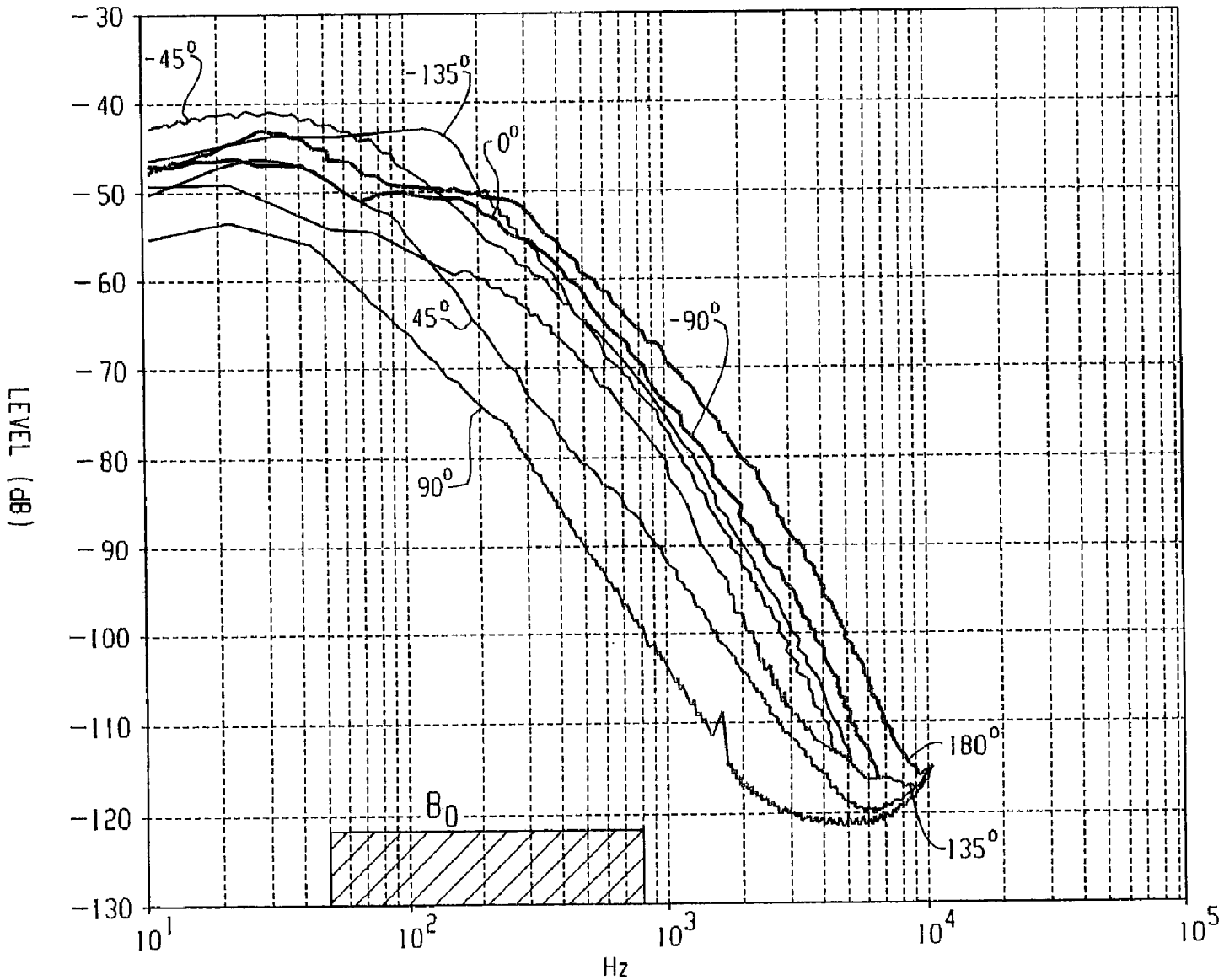
FIG. 1 wind spectra in dependency on wind direction.

In FIG. 1 there is shown wind noise spectral characteristic for a wind speed of 10 m/s at an individual head with no hair. Therefrom it might be seen that wind noise spectrum varies significantly as wind direction alters with respect to a device registering such noise. Nevertheless, wind noise spectrum is band-limited.

In FIG. 1 there is further schematically introduced the approximate frequency band for human speech fundamental pitch.

1st Aspect

Figure 2:
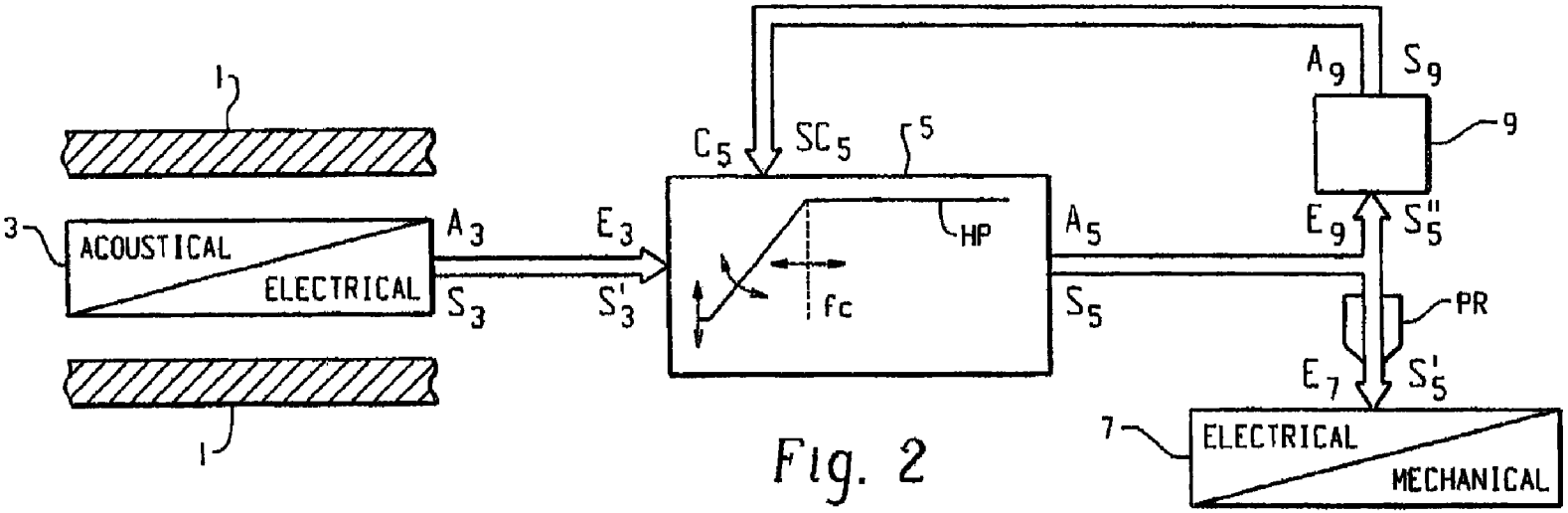
FIG. 2 by means of a simplified schematic functional block/signal flow representation a hearing device operating according to the method of reducing disturbances and manufactured by a method, all according to the present invention under its first aspect.

In FIG. 2 there is shown, by means of a simplified schematic signal-flow/functional block diagram, an acoustical device, especially a hearing device as manufactured according to the present invention under its first aspect. The device as shown performs the method according to the present invention under this first aspect.

The device comprises, assembled into a schematically shown device casing 1, an input acoustical/electrical converter arrangement 3. Such arrangement 3 may comprise one or more than one specific acoustical/electrical converters as of microphones. It provides for an electric output at $A_3$, whereat the arrangement 3 generates an electric signal $S_3$. Possibly via some signal processing, as e.g. pre-filtering and amplifying (not shown), a signal $S_3'$ dependent on $S_3$ is fed to input $E_5$ of a high-pass filter arrangement 5. The filter arrangement 5 has a control input $C_5$ for control signals $SC_5$ which, applied to $C_5$, control the high-pass characteristic as shown in block 5 and with respect to its one or more than one corner frequencies $f_c$, its low-frequency attenuating, one or more than one attenuation slopes. The high-pass filtered signal $S_5$ output at an output $A_5$ and is operationally connected, possibly via further signal processing, especially as will be described in context with the second aspect of the present invention, to one or more than one electrical/mechanical output converter arrangements 7 of the device.

With an eye on manufacturing such device all the units as of 3, 5, 9, 7 will be assembled in a casing, whereby they need not be all assembled in the same casing 1, wherein the input converter arrangement 3 is provided. Further, the addressed operational signal connection may be established during or after assembling of the device, some or even all of them may nevertheless be preassembled as by combining units by an integration technique.

A signal $S_5''$ dependent on signal $S_5$ as output by high-pass filter unit 5, possibly made dependent via additional signal processing as e.g. amplification, is fed from the output $A_5$ to an input $E_9$ of a unit 9, which most generically performs upon the signal $S_5''$ a statistical evaluation. The statistic-forming unit 9 performs registering and evaluating selected characteristics of signal $S''_5$ over time. There results from performing such statistical evaluation that the signal $S_9$ has a low-pass-type dependency from signal $S''_5$ input to unit 9. The output signal $S_9$ at output $A_9$ is operationally connected, possibly by some intermediate additional signal processing, as e.g. amplification or filtering, to the control input $C_5$ as a control signal $SC_5$ and controls the high-pass filter characteristic HP of filter unit 5. As shown in FIG. 2, whenever the improved audio signal as of $S_5$ has to be further processed so as to take individual hearing improvement needs into account, so as customary for hearing aid devices, such processing is performed downstream $S_5$ at a processor unit PR.

Figure 3:
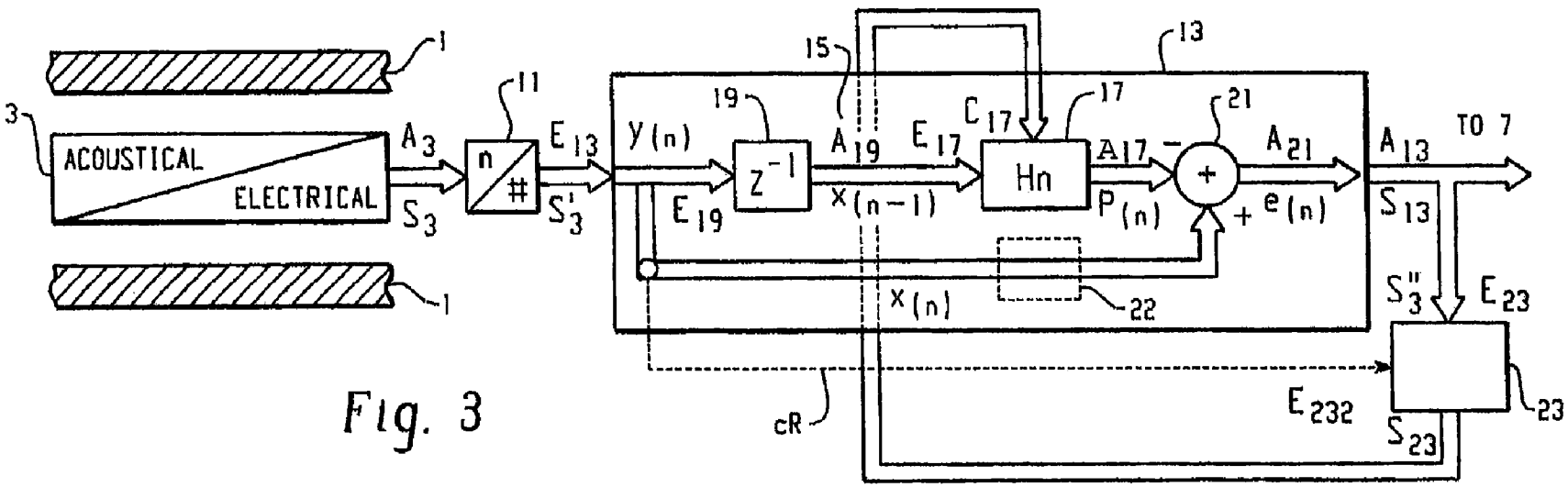
FIG. 3 in a more detailed, but still simplified schematic functional block/signal-flow representation, a preferred embodiment of the invention of FIG. 2.

In spite of the fact that functioning of the most generic embodiment as of FIG. 2 might be better understood when reading the following explanations to FIG. 3 with respect to a preferred form of realization, it is already clear from the embodiment of FIG. 2, that, with an eye on FIG. 1, the high-pass filter arrangement 5 provides for attenuating wind noise has its corner frequency $f_c$ set and adjusted adjacent the upper end of the wind noise spectra, i.e. somewhere between 1 kHz and 10 kHz. The unit 9 generates the output signal $S_9$ which does not vary in time on the basis of short-term single signal variation of $S''_5$, but only with long-term or frequency variations and thereby controls the filter characteristics of filter arrangement 5 to optimize attenuation of such long-term or frequent variations, i.e. signal components as resulting from wind noise. Signal components in $S''_5$ resulting from normal acoustical signals not to be canceled as from speech or music and appearing in $S''_5$ with spectra rapidly changing in time will substantially not be canceled by the filter arrangement 5, at least substantially less than steadily or slowly varying or repeatedly occurring signal components as caused by wind noise.

In FIG. 3 there is shown a most preferred form of realization of the device and method as disclosed with the help of FIG. 2 and accordingly of manufacturing a respectively operated hearing device.

Thereby, signal processing is realized by digital signal processing. Functional blocks and signals, which have already been explained in context with FIG. 2 are shown in FIG. 3 with the same reference numbers. The output signal $S_3$ of input converter arrangement 3 is analog/digital converted by an analog/digital conversion unit 11. The filter arrangement 5 as of FIG. 2 is realized by a digital filter unit 13. The signal $S_3'$ as input according to FIG. 2 to the filter arrangement 5 is now digital and applied to the input $E_{13}$ of digital HP-filter unit 13. The high-pass—HP—filter arrangement 5 is realized making use of a predictor 15. It comprises a time delay unit 19 and a low-pass digital filter 17, which may be of FIR or IIR type and may be of any particular implementation, e.g. of lattice, direct form, etc. structures.

Signal samples x(n) from input signal $S'_3$ are input to time delay unit 19, at its input $E_{19}$. Delayed samples x(n−1) at output $A_{19}$ of unit 19 are input at input $E_{17}$ to low-pass filter unit 17, whereat the samples are low-pass filtered to generate at an output $A_{17}$ an output signal p(n). The units 19 and 17 represent as known to the skilled artisan a predictor and the output signal p(n) is the prediction result.

The prediction result p(n) is compared by subtraction at a subtraction unit 21 with the actual sample x(n) of the actual input signal according to $S'_3$. Thereby, the output $A_{17}$ of filter unit 17 is operationally connected to one input of comparing unit 21, the other input thereof being operationally connected to the input $E_{13}$ of high-pass filter unit 13 without substantial frequency filtering. A matching time delay unit may be introduced in the connection from input $E_{13}$ to the one input of unit 21 as shown in dashed lines at 22.

At the output $A_{21}$ of the comparing unit 21 the predictor error signal e(n) is generated, which is indicative for the deviation of the prediction result p(n) from actual signal x(n).

The low-pass filter unit 17 has a control input $C_{17}$. A control signal applied to that input $C_{17}$ adjusts the coefficients and/or adaption time constants of the digital filter unit 17. The input $C_{17}$ of low-pass filter unit 17 represents, with an eye on FIG. 2, the control input $C_5$ of the high-pass filter arrangement 5.

The signal $S_{13}$ according to the predictor error e(n), is on one hand and as was explained in context with FIG. 2 operationally connected to at least one electrical/mechanical output converter (not shown here) of the device.

Further, a signal $S_{13}''$, which depends, possibly via some additional signal processing as e.g. amplification, to signal $S_{13}$ is input to input $E_{23}$ of statistics forming and evaluating unit 23. In a most preferred embodiment unit 23 monitors the overall energy of the signal $S''_{13}$. The control signal $C_{17}$ to the low-pass filter unit 17 is made dependent from the output signal $S_{23}$ of unit 23, which is representing the overall energy of the input signal $S_{13}''$. Thereby, in fact in the sense of a negative feedback control loop via control input $C_{17}$, the adaption time constants and/or the filter coefficients of filter unit 17 are adjusted to minimize the energy of signal $S''_{13}$ and thus of $S_{13}$. Thereby, LMS type algorithms or other algorithms like Recursive Least Square (RLS) or Normalized Least Means Square (NLMS) algorithms may be used. In a different embodiment the unit 23 may estimate speech signal intelligibility at signal $S_{13}''$ e.g. by computing from that signal speech an intelligibility index. In a still further embodiment, unit 23 may estimate speech signal quality e.g. by segmental SNR computation.

If unit 23 performs evaluation of statistics based on a correlation, and as shown in dotted line at CR in FIG. 3, the input $E_{13}$ may be operationally connected to a further input $E_{232}$ of statistics forming and evaluating unit 23.

Although the embodiment of FIG. 3, as has been explained, operates in time domain, the same principal may be realized in frequency domain.

As the filter unit 17 is adjusted to minimize the energy of e(n), the predictor 19, 17 will reconstitute the predictable parts of signal x(n) as accurately as possible. Therefore, the prediction error e(n) will only contain non-predictable parts of signal x(n). Because wind noise constitutes substantially predictable components of x(n) and, in opposition, signals to be perceived as especially from speech or music, are non-predictable parts of x(n), the wind noise components are canceled from the output signal $S_{13}$, finally acting upon the output converter 7, whereas speech or music signals, as non-predictable signals, are passed by $S_{13}$ to the converter 7.

Experiments have shown that the order of the digital filter 17 may be low, preferably below $5^{th}$ order FIR. The resulting filter is thus cheap to implement and still very efficient. Such low-order filter has additionally the advantage of allowing relatively fast adaption times, thus enabling tracking fluctuations of wind noise accurately. Further, it has been found that by the disclosed technique, especially according to FIG. 3, wind noise is substantially more attenuated than target signals like speech or music, thereby improving comfort and signal-to-noise ratios.

The skilled artisan being taught the invention under the first aspect may find other adaptive filter structure to realize the principal technique as disclosed.

2nd Aspect

Under this second aspect of the present invention two techniques have been invented, one generically improving signal-to-noise ratio at an acoustical device, especially hearing device, the other one doing so especially with an eye on speech target signals. As will be shown both techniques are considered per se and self-contained as inventions, but are most preferably combined with the teaching under the first aspect of the invention to further improve low-frequency target signals within a frequency band covered by wind noise spectrum.

1st Sub-Aspect

Figure 4:
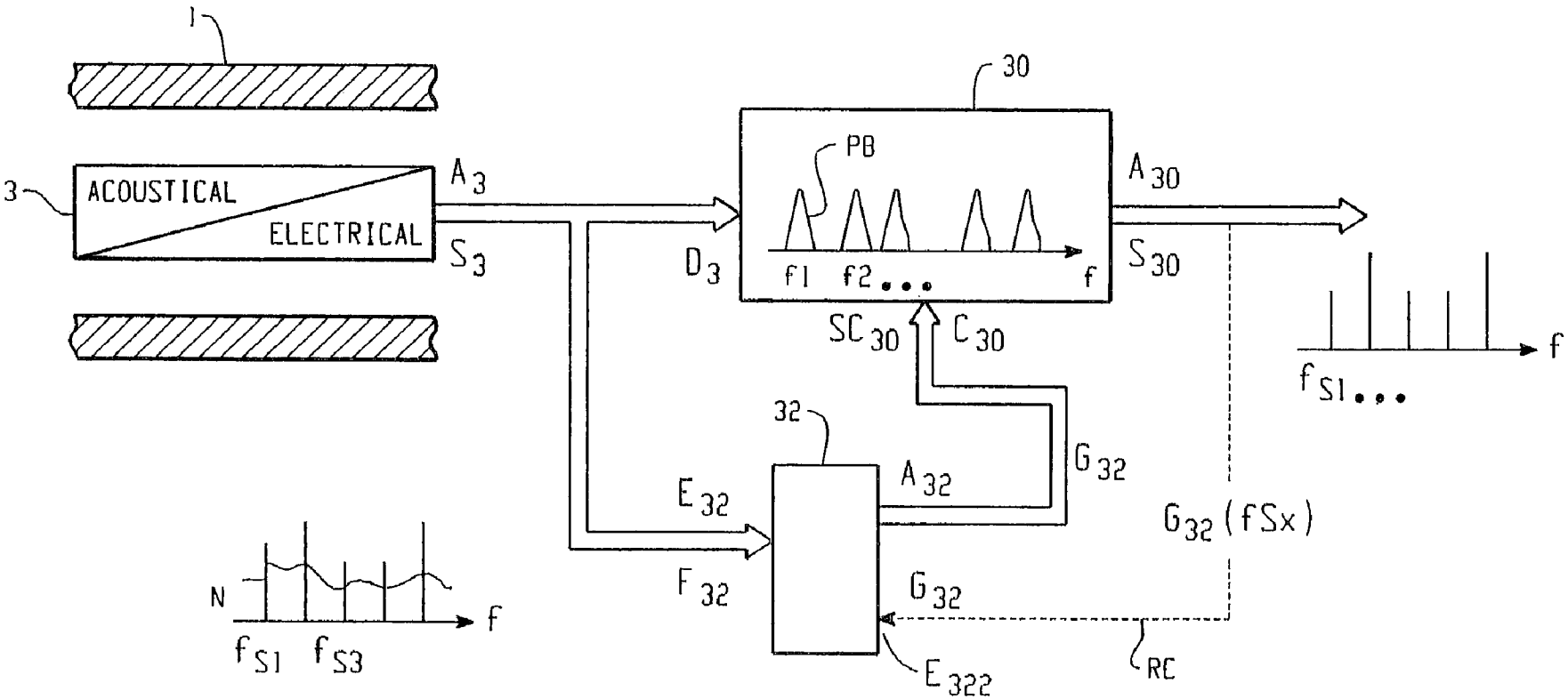
FIG. 4 in a simplified schematic functional block/signal-flow representation an acoustical device which operates the method for improving signal-to-noise ratio and is manufactured by a method, all according to the present invention under a first sub-aspect of a second aspect.

FIG. 4 shows, by means of a simplified, schematic functional block/signal-flow diagram an acoustical device, especially a hearing device as manufactured by the present invention, thereby disclosing a hearing device according to the present invention, which performs the signal processing method according to the present invention, namely under the first sub-aspect of its second aspect.

According to FIG. 4 an input acoustical/electrical converter arrangement 3, which again may be equipped with one or more than one input acoustical/electrical converters as of microphones, provides at its output $A_3$ the signal $S_3$.

A signal $D_3$ which is dependent from $S_3$, especially preferred dependent by having been processed by an arrangement as was disclosed in context with FIGS. 2 and 3 and thus the first aspect of the present invention, is input to a pitch filter unit 30.

The pitch filter unit 30 is a comb filter as schematically shown within the block of unit 30 with a multitude of pass-bands PB. The filter characteristic of the pitch filter unit 30 is adjustable by a control signal $SC_{30}$ applied to a control input $C_{30}$. Thereby, especially the spectral positions as of $f_1$, $f_2$ . . . of the pass-bands PB are adjusted. A further signal dependent on the signal $S_3$, preferably with the same dependency as $D_3$, $F_{32}$, is input to an input $E_{32}$ of a pitch detector unit 32.

Whenever signal $F_{32}$ has pitch components as schematically shown at the frequencies $f_{s1}$, . . . , $f_{s3}$ exceeding noise spectrum N the pitch detector unit 32 detects the pitch frequencies $f_{sx}$ and generates at its output $A_{32}$ an output signal $G_{32}$ which is indicative of spectral pitch position, i.e. of the pitch frequency $f_{sx}$ of input signal $F_{32}$.

The output $A_{32}$ of pitch detector unit 32 is operationally connected to the control input $C_{30}$ so as to apply there the control signal $SC_{30}$ which is indicative of spectral pitch positions within signal $F_{32}$ and thus $S_3$.

At the adjustable pitch filter unit 30 the spectral positions of the pass-bands PB are thereby adjusted to coincide with the spectral pitch position $f_{Sx}$ in signal $F_{32}$ and thus in signal $S_3$, so that at the output $A_{30}$ of the adjustable pitch filter unit 30 a signal $S_{30}$ is generated, whereat the noise spectrum according to N is substantially attenuated, whereas the pitch components are passed.

If the pitch detector unit 32 operates on the basis of a recursive detection technique, a further input $E_{322}$ of unit 32 is operationally connected to the output $A_{30}$ of pitch filter unit 30.

This is shown in FIG. 4 by dashed lines at RC.

As not shown in FIG. 4 again the output signal $S_{30}$ is further processed by the device specific signal processor, especially to consider individual needs with respect to hearing improvement as was addressed in context with FIG. 2 and is finally operationally connected via such possible signal processing to at least one output electrical/mechanical converter 7.

By the technique under this sub-aspect, signal-to-noise ratio of the device is significantly improved.

Again with an eye on the method for manufacturing such a device, establishing operational connections between the respective units may at least to a certain extent be done before assembling such units to the one or more than one device casings, one of them being schematically shown in FIG. 1 at reference No. 1.

Figure 5:
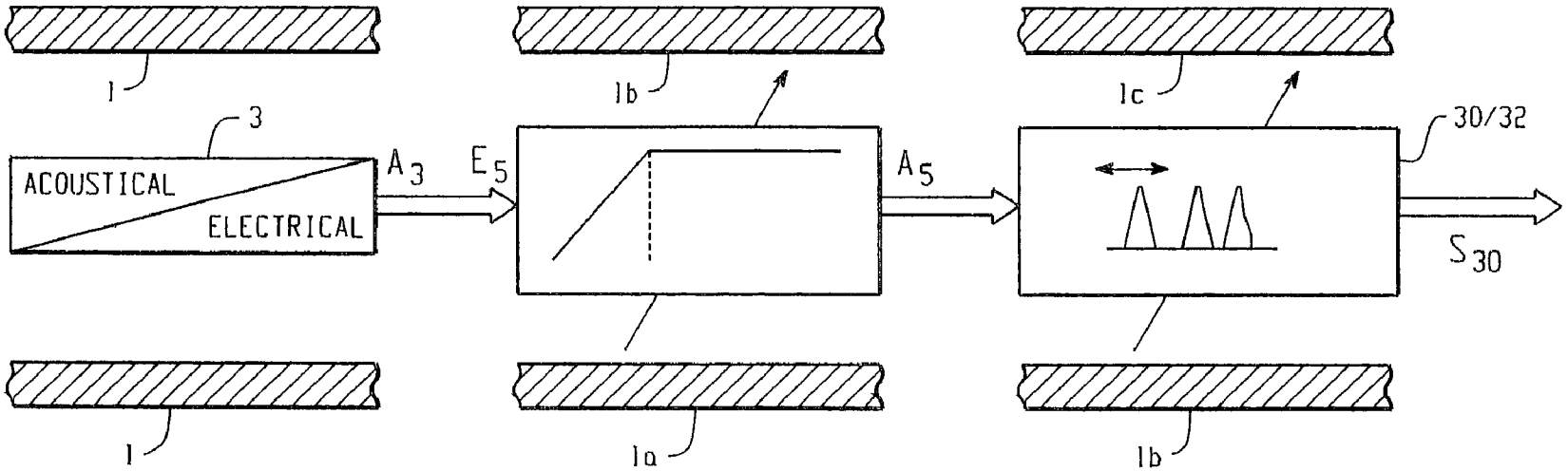
FIG. 5 in a simplified schematic functional block/signal-flow representation a preferred embodiment combining the invention under its first aspect and the invention under the first sub-aspect of the second aspect.

The teaching according to this sub-aspect of the present invention may ideally be combined with the teaching of the present invention under its first aspect. This is schematically shown in FIG. 5. Thereby, the output $A_3$ of the input converter arrangement 3 is operationally connected, again preferably via an analog to digital conversion unit (not shown), to the input $E_5$ of filter arrangement 5, preferably realized according to FIG. 3, the output thereof, $A_5$, being operationally connected to the adjustable pitch filter system 30/32 as of FIG. 4. Thereby, the pitch filter unit 30 in a preferred mode of realization will especially be tailored with pass-bands within the wind noise spectrum as of FIG. 1, thereby to reestablish pitches, i.e. frequency components of the tracking signals especially of speech or music signals in that spectral band.

Nevertheless, the technique according to this sub-aspect, i.e. applying a controllably adjustable pitch filter, may be more generically used to reduce signal-to-noise ratio with respect to tracking signals especially at acoustical devices.

2nd Sub-Aspect

The teaching according to this second sub-aspect is more specifically directed on improving speech signals.

Figure 6:
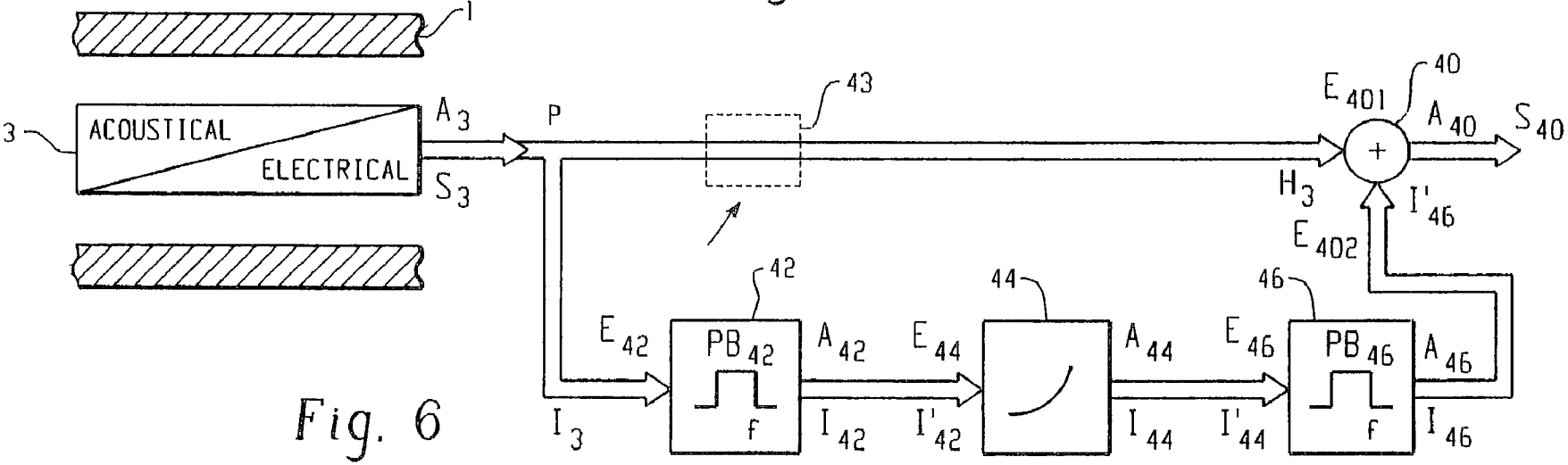
FIG. 6 an acoustical device operating a method for increasing signal-to-noise ratio and manufactured by a method all according to the present invention under a second sub-aspect of its second aspect.

According to FIG. 6 an input acoustical/electrical converter arrangement 3 has an output $A_3$. A signal $H_3$ which depends from the signal $S_3$ output from input converter arrangement 3 is fed to a first input $E_{401}$ of an adding unit 40. At a point P along signal transfer path between $S_3$ and $H_3$ a signal $I_3$ is branched off. The operational connection of the output $A_3$ to the branching point P is thereby, in a preferred mode, established via the high-pass filtering unit as was explained with the help of FIGS. 2 and 3 and in context with the first aspect of the present invention as will be explained later. With respect to frequency content there occurs substantially no frequency filtering in the signal transfer path between branching point P and $E_{401}$, which would be different from such filtering of signal $I_3$. The signal $I_3$ is input to an input $E_{42}$ of a band-pass filter unit 42 with a pass-band $PB_{42}$. At the output $A_{42}$ of band-pass unit 42 an output signal $I_{42}$ is operationally connected to an input $E_{44}$ of a non-linear modulation unit 44.

At unit 44 the input signal $I'_{42}$ is modulated at a nonlinear e.g. parabolic characteristic. The modulation result signal $I_{44}$ at output $A_{44}$ is operationally connected to input $E_{46}$ of a second band-pass filter or of a low-pass filter unit 46, without significant frequency filtering.

Unit 46 generates at its output $A_{46}$ a signal $I_{46}$. A signal $I'_{46}$ dependent from the signal $I_{46}$ without significant frequency filtering is applied to the second input $E_{402}$ of adding unit 40, generating at its output $A_{40}$ the signal $S_{40}$. This output signal $S_{40}$ is (not shown) operationally connected to further signal processing units of the acoustical device, especially the hearing device, which accomplishes device-specific and/or user-specific signal processing.

Figure 7:
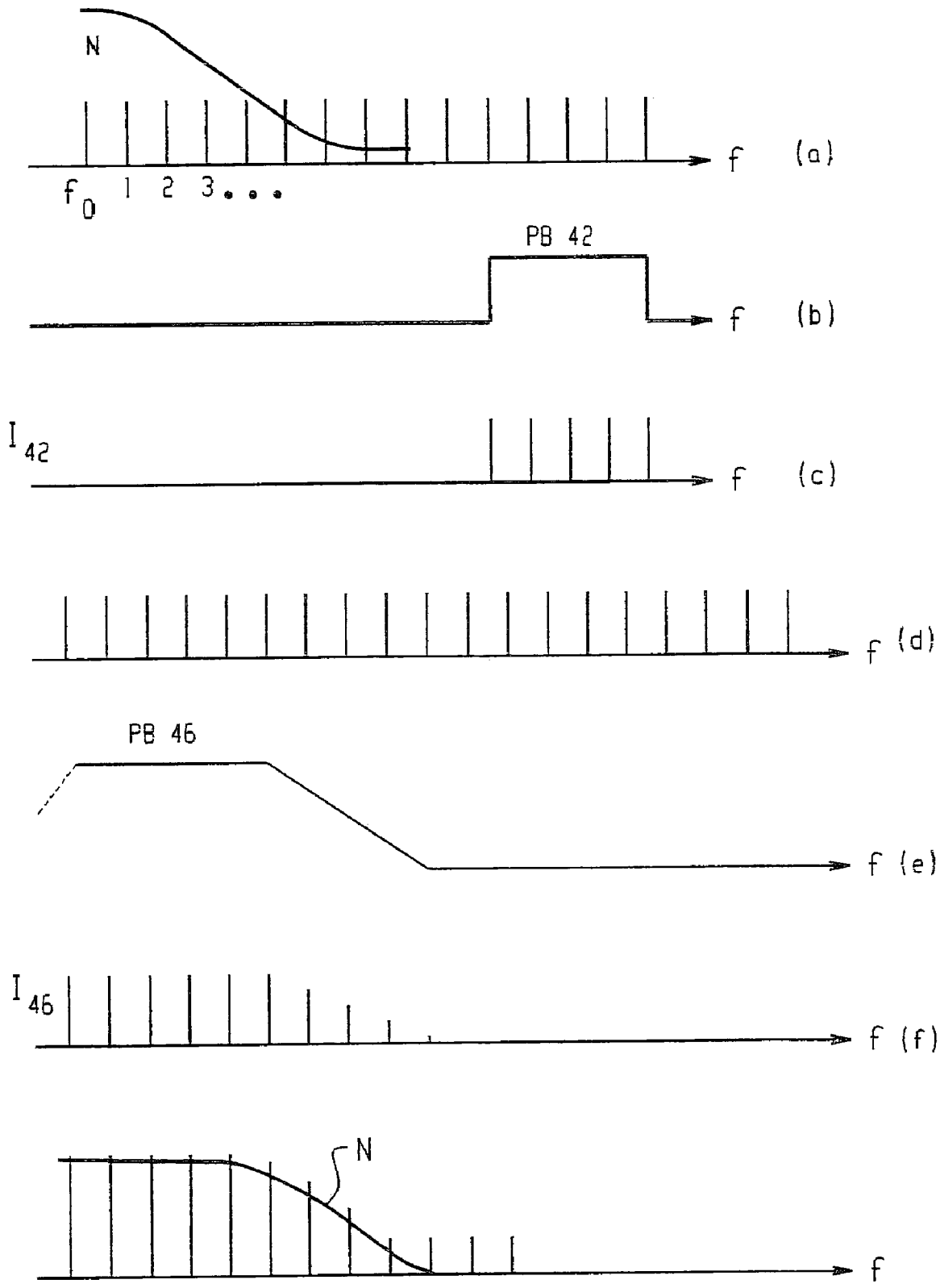
FIG. 7 simplified spectra for explaining functioning of the device and method as shown in FIG. 6.

The functioning of the device or method as shown in FIG. 6 and thereby specific selection of the filtering characteristics, especially of units 42 and 46, shall be explained with the help of FIG. 7.

In FIG. 7(*a*) there is schematically shown on one hand wind noise spectrum N and on the other hand the fundamental of a speech signal and its harmonics 1, 2, 3, . . . . It may be seen that whereas fundamental and lower harmonics have bad SNR, higher harmonics have increasingly better SNR.

According to FIG. 7(*b*) the pass-band $PB_{42}$ of unit 42 is selected to pass high SNR harmonics, resulting in $I_{42}$ as of FIG. 7(*c*).

This signal is subjected at unit 44 to non-linear modulation. As perfectly known to the skilled artisan by such non-linear modulation, e.g. at a parabolic characteristic, new harmonics are produced as generically shown in FIG. 7(*d*), also considering intermodulation products and folding at the zero-frequency axes.

It has to be noted that these harmonics are spectrally located exactly there where the harmonics and fundamental of the original speech signal according to FIG. 7(*a*) are located.

The signal $I_{44}$ with good SNR or the signal dependent therefrom is fed to unit 46 with a filter characteristic as shown in FIG. 7(*e*), whereat those harmonics within signal $I_{44}$ according to FIG. 7(*d*) are canceled or filtered out, which do not accord with original speech harmonics according to FIG. 7(*a*) to be improved as shown in FIG. 7(*e*). At adding unit 40 the signal $I'_{46}$ with the spectrum according to 7(*f*) possibly amplified is added to the signal $H_3$ with a spectrum according to FIG. 7(*a*) resulting in an output signal $S_{40}$ with speech fundamental and lower harmonics significantly improved with respect to SNR, and as shown in FIG. 7(*g*).

Thus, the pass-band PB 42 of unit 42 is selected to coincide spectrally with a harmonics of speech with relatively good SNR and the characteristic of filter unit 46 is selected so that in the resulting signal harmonics are present, which coincide spectrally with the poor SNR fundamental and lower harmonics of speech to be improved with respect to SNR.

The embodiment as shown in FIG. 6 may thereby be implemented digitally by providing down-stream $A_3$ (not shown) an analog to digital conversion unit and further may be implemented by signal processing in frequency or frequency band domain, thereby adding respective time domain to frequency or frequency band domain conversion units.

As further shown in FIG. 6 a delay unit 43 may be provided between point P and input $E_{401}$ to compensate for time delays between P and $E_{402}$.

With an eye on the method of manufacturing a device according to FIG. 6 with a device casing 1, the remaining units are provided and assembled in the same casing or in different casings, the operational connections between the different units being established before, at or after assembling the units in the one or more than one casings.

In a most preferred form the technique as disclosed with FIGS. 6 and 7 is combined with upstream high-pass filtering of the output signals of the input converter arrangement 3, thereby especially preferred with adjustable high-pass filtering as was explained with the help of the FIGS. 1 and 2 and which accords to the present invention under its first aspect.

Figure 8:
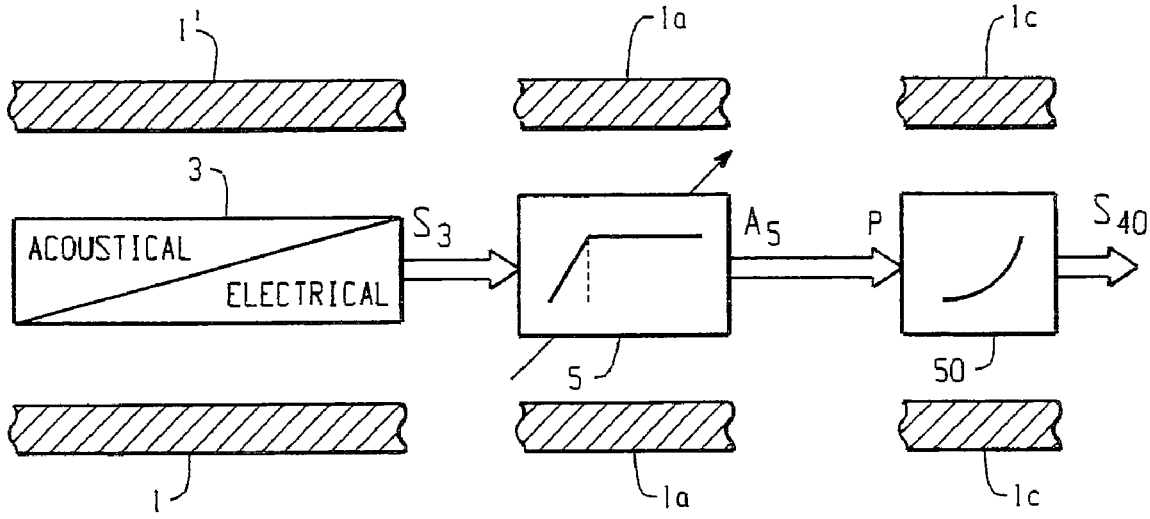
FIG. 8 in a simplified functional block/signal-flow diagram a preferred combination of the invention under its first aspect with the invention under the second sub-aspect of its second aspect.

This is schematically shown in FIG. 8. The system according to this FIG. 8 needs not be additionally described, besides of the fact that the system according to FIG. 6 between branching point P and output signal $S_{40}$ is considered residing in unit 50.

3*rd* Aspect

Under all the aspects of the present invention discussed up to now the addressed input acoustical/electrical converter arrangement may comprise one or more than one distinct input acoustical/electrical converters as of microphones and may thereby provide for beamformer characteristics. Nevertheless, the arrangement may also comprise only one distinct acoustical/electrical input converter.

In contrary thereto, the present invention under its third aspect is directed on acoustical devices, especially hearing devices with a mores specific input converter arrangement.

Figure 9:
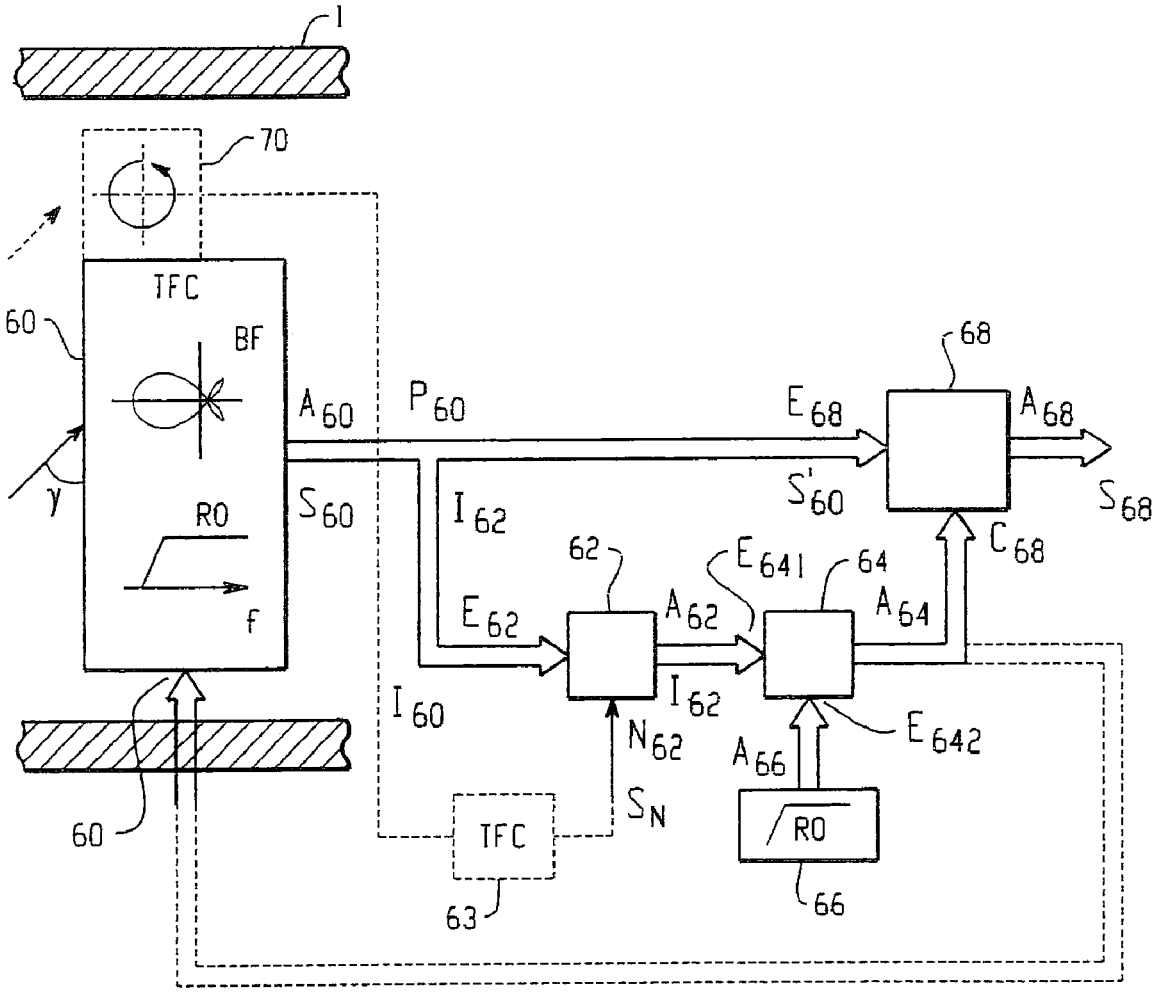
FIG. 9 by means of a simplified schematic functional block/signal-flow diagram an acoustical device operating according the method for at least substantially canceling wind disturbances and manufactured by a method, all according to the present invention under its third aspect.
Figure 10:
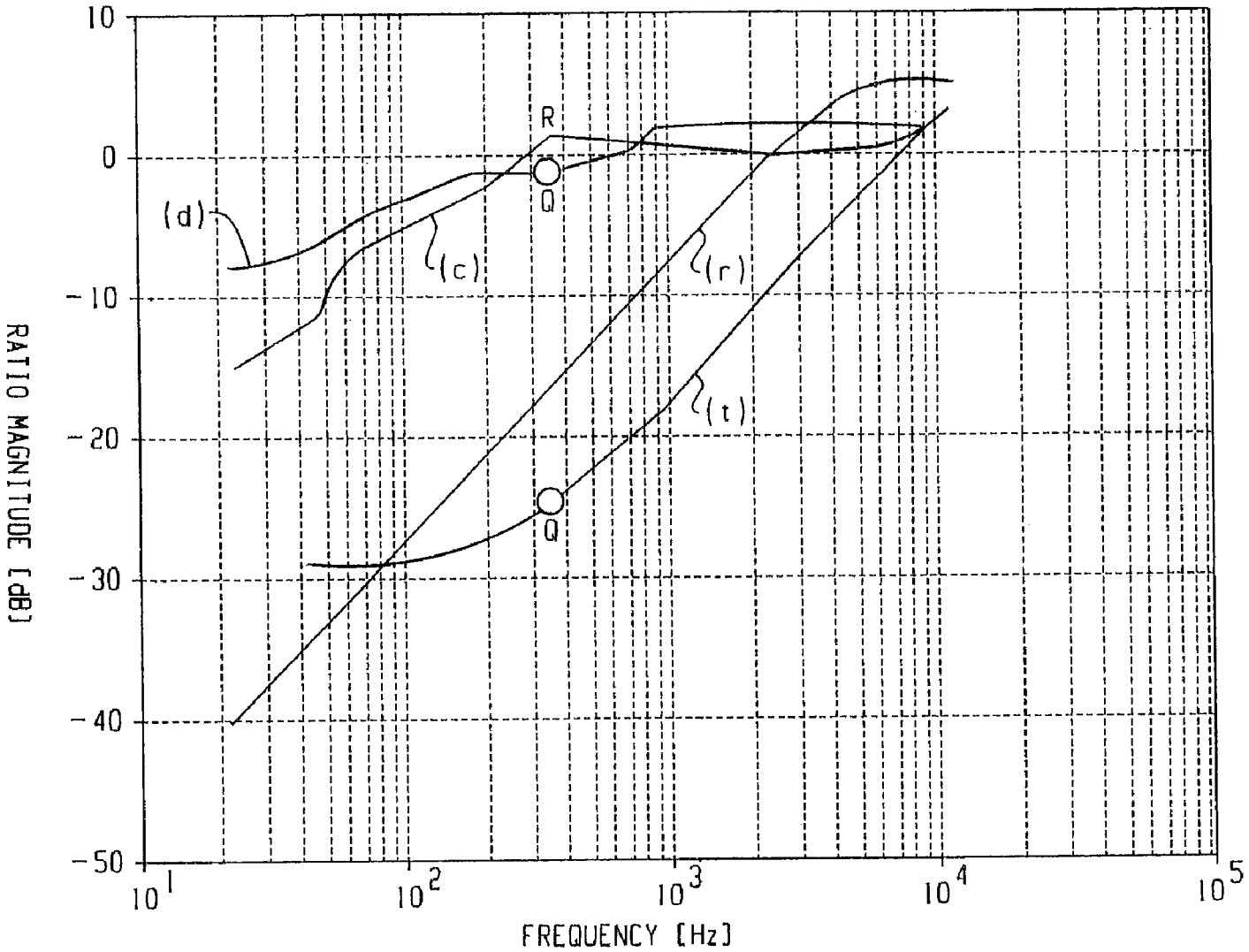
FIG. 10 as an example a roll-off characteristic (a), speech as well as wind spectra for explaining the effect of the invention under its third aspect.

According to FIG. 9 there is provided an input acoustical/electrical converter arrangement 60 with an output $A_{60}$ generating there an output signal $S_{60}$. The input converter arrangement 60 has the following characteristics:

a) It provides for a beamformer amplification characteristics BF, i.e. with a specific amplification characteristic of acoustical input signals ACU to electric output signal $S_{60}$ in dependency of direction of arrival $\phi$ with which such acoustical signals ACU impinge on a sensing area of the arrangement 60.

b) The beamformer characteristic of amplification has a predetermined roll-off characteristic RO. This roll-off characteristic defines for a considered DOA angle $\phi$, how the amplification is attenuated as a function of signal frequency. Such a roll-off characteristic over frequency is shown in FIG. 10 by course (a).

c) Further, within the input converter arrangement 60 analog to digital conversion as well as time domain to frequency or frequency band domain conversion is performed.

Such beamformer arrangements are known. The beamformer characteristics may thereby be realized by applying a single, discrete input acoustical/electrical converter with an intrinsic directional characteristic or may be implied by means of more than one distinct input acoustical/electrical converters, e.g. following the well-known delay-and-add technique.

The output signal $S_{60}$ in frequency or frequency band domain or a signal dependent therefrom is branched at branching point $P_{60}$. Signal $I_{62}$, still dependent on output signal $S_{60}$, is input to the input $E_{62}$ of a normalizing unit 62. There each frequency sample of prevailing, actual value is normalized by a signal $S_N$ value fed to normalizing input $N_{62}$ of unit 62. For each frequency sample the normalizing unit 62 generates at output $A_{62}$ a normalized value as signal $I_{62}$, a signal dependent therefrom being fed to one input $E_{641}$ of a comparing unit 64. A storing unit 66 is provided wherein the predetermined roll-off characteristic RO is stored. The output $A_{66}$ thereof is operationally connected to the second input $E_{642}$ of comparing unit 64. The output $A_{64}$ with the comparison result is fed to a control input $C_{68}$ of a selection unit 68. A signal input $E_{68}$ of that unit is operationally connected via branching point $P_{60}$ to the output $A_{60}$ of converter arrangement 60. Unit 68 generates signal $S_{68}$ at output $A_{68}$.

The roll-off characteristic RO is defined as the quotient of a spectral component of a considered frequency at output signal $S_{60}$ to the value of the respective component in the acoustical signal impinging on the sensing area of arrangement 60. From unit 66, for each frequency sample f' a roll-off value is fed to unit 64. For comparison purposes the respective sample prevailing in signal $I_{60}$ must be normalized before any meaningful comparison may be performed at unit 64 with the respective frequency-specific roll-off value.

Thus, the normalizing value $S_N$ fed to normalizing unit 62 must be dependent as accurately as possible on the actual value of frequency components of the acoustical signal impinging on converter arrangement 60.

If within the input acoustical/electrical converter arrangement 60 beamforming is achieved with a single discrete directional converter, as with a microphone with directional characteristic, preferably a second microphone will be installed e.g. in arrangement 60. Its output signal, after time domain to frequency or frequency band domain conversion, is operationally connected to the input $N_{62}$ of the normalizing unit 62 as normalizing signal $S_N$. Thereby such an additional acoustical/electrical converter is preferably selected to have an omnidirectional characteristic.

As shown in dashed lines in FIG. 9 such additional standardizing input converter 70 has an output, in fact forming a further output of converter arrangement 60, which is operationally connected to the input $N_{62}$ of normalizing unit 62 after time to frequency of frequency band domain conversion TFC at a unit 63. Thus, at the normalizing unit 62 each prevailing frequency sample of signal $I_{60}$ will be normalized with the value of respective spectral component of the acoustical signal.

Another possibility of normalizing the signal $I_{60}$ in the case of providing a directional input converter in arrangement 60 is to continuously average the signal after beamforming overall frequencies and over a predetermined amount of time and to apply the average result to input $N_{62}$. In this case the input acoustical/electrical converter arrangement 60 needs only to be provided with a single input acoustical/electrical converter with intrinsic beamforming ability and the normalizing signal $S_N$ is established from the signal $I_{60}$. Nevertheless it appears that such processing will be less accurate than processing normalization by the actual spectral component values of the acoustical signal as is performed with a normalizing omnidirectional converter 17.

Very often the beamforming ability of the input acoustical/electrical converter arrangement 60 is achieved by means of at least two discrete input acoustical/electrical converters, the output signals thereof being processed e.g. according to the well-known delay-and-add principal.

Figure 11:
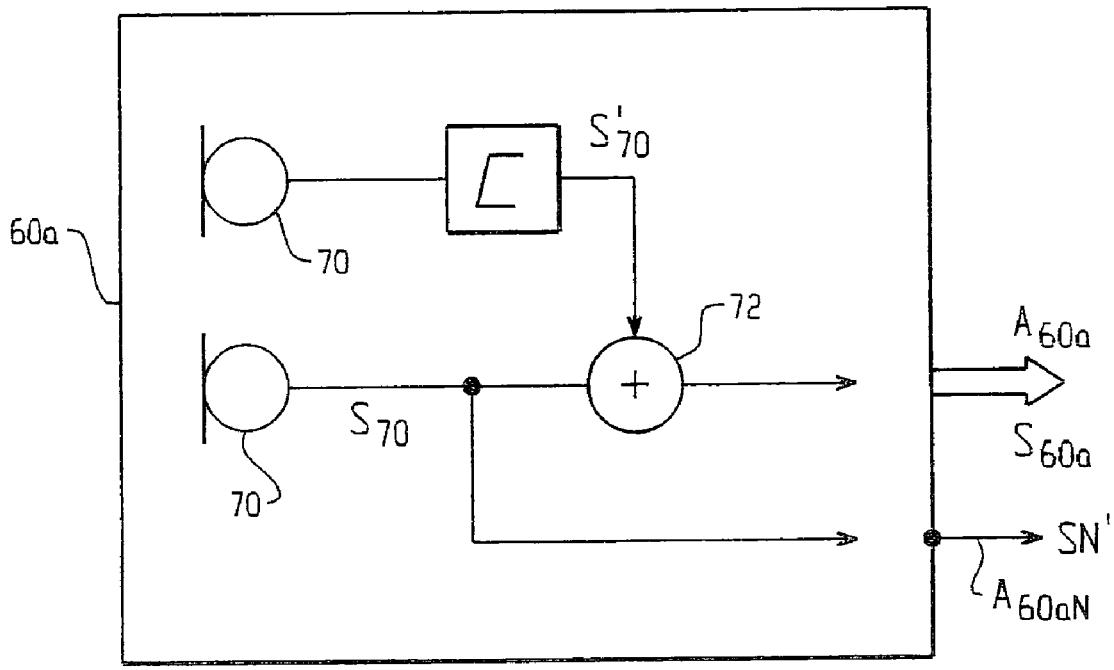
FIG. 11 by means of a simplified schematic functional block/signal-flow representation a preferred input acoustical/electrical converter arrangement as preferably used in the embodiment of FIG. 9.

In this case providing normalizing signals is quite simple. This is shown schematically in FIG. 11. The input acoustical/electrical converter arrangement **60*a* has at least two distinct input acoustical/electrical converters 70, the output thereof being processed e.g. and as shown by the well-known delay-and-add method. As each single distinct converter 70 provides at its output an output signal yet not having been subjected to beamforming, which is performed in a beamformer processing unit 72, each of the output signals $S_{70}$ and $S_{70}'$ has spectral components with the value according to that component in the impinging acoustic signal. The signal of one of the distinct input converters is directly tapped off after time domain to frequency or frequency band domain conversion to an output $A_{60aN}$ of arrangement 60*a*** and a signal dependent therefrom is operationally connected to the input $N_{62}$.

In comparing unit 64 there is monitored for each frequency sampled whether the actual normalized value has a predetermined relationship with respect to the roll-off value. In a most preferred embodiment it is established for each normalized frequency sample value, whether it is at most equal to the roll-off value. The output signals at the output $A_{64}$ of comparing unit 64 thereby indicate for which specific frequency the normalized value fulfills the predetermined comparison criterion, thus, as preferred, whether the normalized value is at most equal to the roll-off value.

In the selection unit 68, to which by input signal $S'_{60}$ the instantaneously prevailing frequency samples are fed, only those samples are passed for which the normalized samples fulfill the requested predetermined comparison criterion. Canceling the samples at those frequencies which do not fulfill the comparison criterion is easily done by establishing in the control signal applied to $C_{68}$ a zero for that not fulfilling frequency component and multiplying at the selection unit 68 the respective frequency samples by zero.

With an eye on FIG. 10 the spectral characteristic (b) represents clean speech, the characteristics (c) and (d) respectively represent strong and weak wind noise. As was said characteristic (a) represents typical roll-off characteristic.

By comparing the characteristics as of FIG. 10 with the embodiment and method of FIG. 9, especially with the preferably established comparison criterion according to which only samples of those frequencies are passed by unit 68, for which the value of the normalized sample is at most equal to the roll-off value, it may be seen that all samples Q below the roll-off characteristic (a) will be passed, whereas samples R above that roll-off characteristic (a) will be cancelled at selection unit 68.

Figure 12:
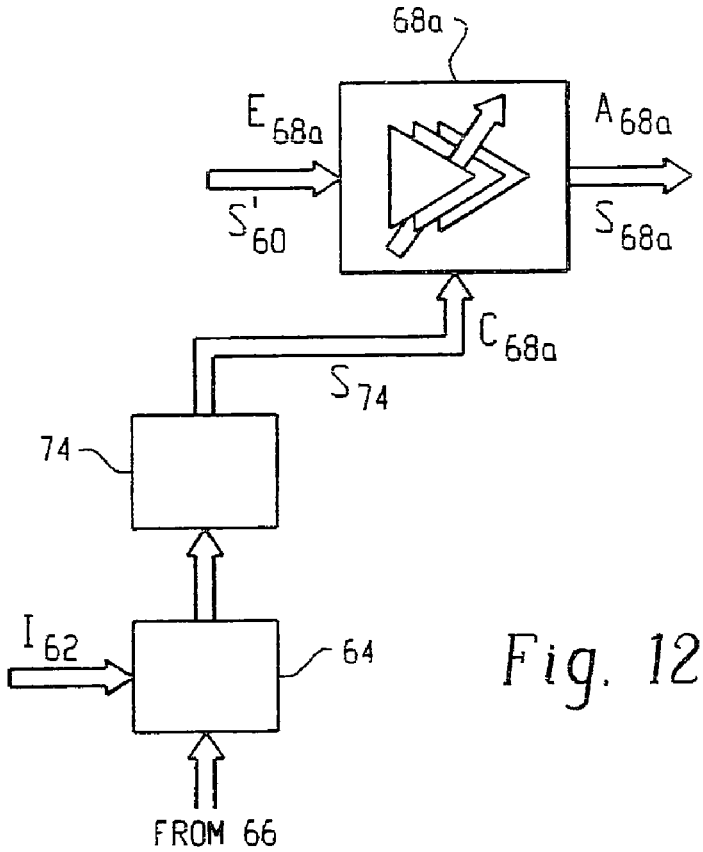
FIG. 12 by means of a simplified schematic functional block/signal-flow representation a preferred embodiment of signal control as preferably applied to the invention as explained with the help of FIGS. 9 to 11.

Following up the description of FIG. 9 up to now, the spectral components or frequency samples prevailing in signal $S_{62}$ are rather binaurally passed or not passed to output signal $S_{68}$. Very often and for many appliances as especially for hearing devices, thereby especially hearing aid devices, such binary switching is not optimal. In FIG. 12 there is shown by means of a simplified schematic signal-flow/functional block representation a preferred embodiment of establishing control between the comparing unit 64 and frequency sample selection at a selection unit **68*a*. The unit 68*a* as well as 64 are operationally connected and fed with signals as was described with the help of FIG. 9. As was explained with the help of FIG. 9 at the output of comparing unit 64 there appears specifically for each frequency or frequency band a control signal, which indicates whether the respective normalized value of the respective samples do or do not fulfill the predetermined comparison condition. These signals are, according to FIG. 12 first operationally connected to a unit 74 which has a transfer characteristic of low-pass type. This results in an output signal $S_{74}$, which is a continuously varying average signal specifically for each frequency or frequency band. Thus, the control signals applied to $C_{68a}$ are not anymore binary pass/not pass control signals for unit 68, but do continuously or steadily vary between predetermined maximal and minimal values. Additionally the selection unit 68 of FIG. 9 is replaced by a frequency or frequency band selective attenuation unit 68*a***, in which frequency or frequency band specifically, the value of the frequency samples are attenuated, controlled by the frequency- or frequency band-specific control signals applied to $C_{68a}$.

Thereby, it is achieved that samples at those frequencies, whereat the respective normalized values do not fulfill the criterion frequently or during predetermined time spans are more and more attenuated in time up to finally disappearing in output signal $S_{68a}$.

$4^{th}$ Aspect

Under the fourth aspect of the present invention a beamforming technique is proposed in which frequency or frequency band specifically beamforming may be controlled. This technique under the fourth aspect of the present invention may be ideally combined with the technique as was explained in context with FIG. 9 to 12, i.e. in context with the third aspect of the present invention. This invention shall be explained with the help of FIG. 13.

A beamformer arrangement 80 comprises at least two distinct input acoustical/electrical converters $\mathbf{80}_a$ and $\mathbf{80}_b$. The electric outputs of the converters $\mathbf{80}_a$ and $\mathbf{80}_b$ are respectively connected to inputs $E_{82a}$ and $E_{82b}$ of respective time domain to frequency or frequency band domain conversion—TFC—units 82*a* and 82*b*.

Figure 13:
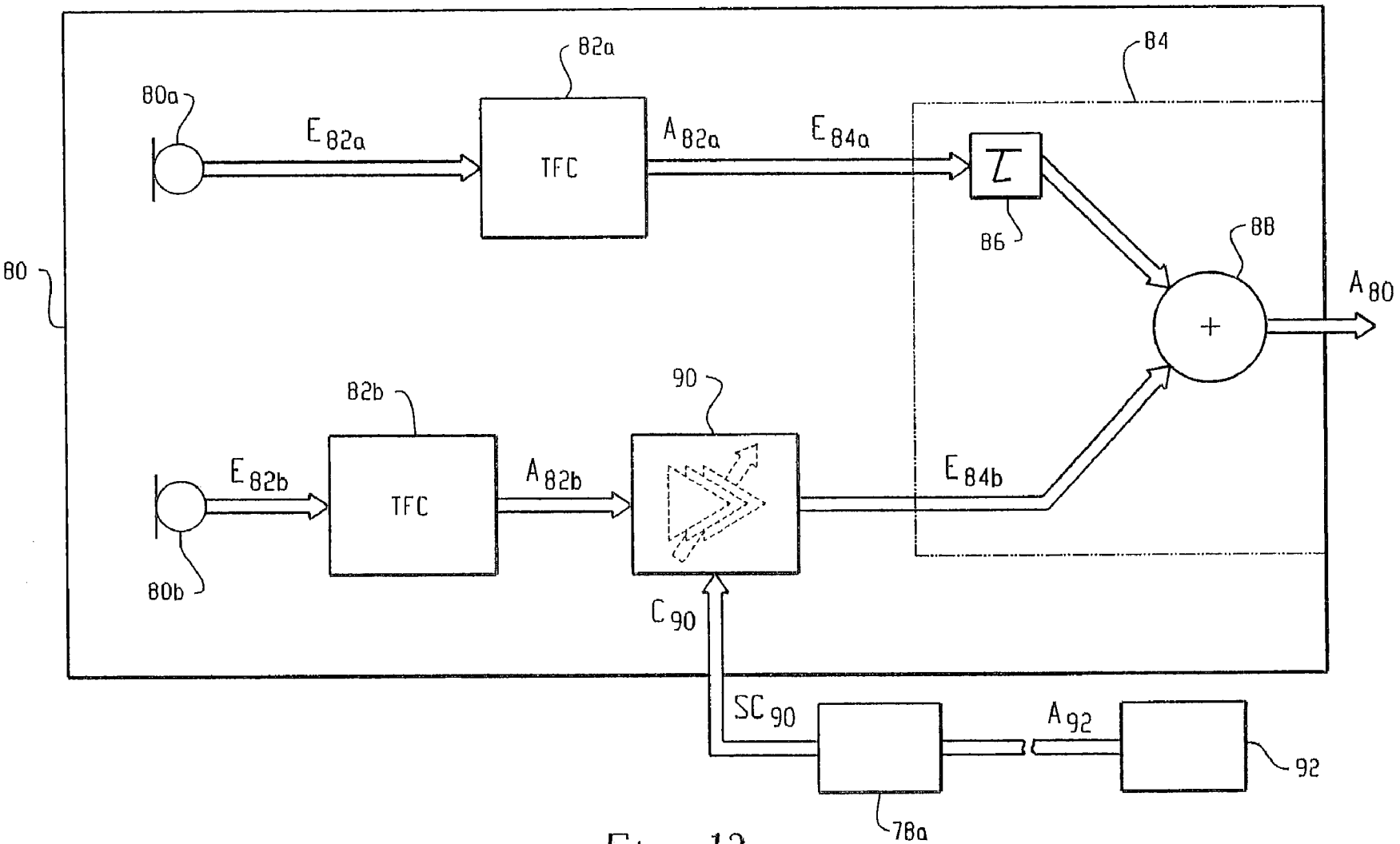
FIG. 13 by means of a simplified schematic functional block/signal flow representation a beamforming device operating the method for controlling beamforming and manufactured by a method, all according to the present invention under its fourth aspect, and FIG. 14 by means of a simplified functional block/signal-flow representation an acoustical device operating to perform the method of detecting wind noise and manufactured by a method, all according to the present invention under its fifth aspect.

The outputs $A_{82a}$ and $A_{82b}$ are generically input to a beamformer processing unit shown in FIG. 13 within dashed-pointed lines and referred to by the reference No. 84. When beamformer processing is done by the known delay-and-add principle, such beamformer processing unit 84 incorporates a—preferably controlled—delaying unit 86 and an adding/subtracting unit 88. Both output signals of the TFC units 82*a* and 82*b* are operationally connected to the respective inputs $E_{84a}$ and $E_{84b}$ of the beamformer processing unit 84. At least one of the operational connections between the respective outputs of the TFC units and respective inputs of the beamformer processing unit 84 comprises a frequency or frequency band selective control unit 90. The control unit 90 has a control input $C_{90}$ to which control signals $SC_{90}$ are fed.

The control unit 90 is construed in fact equally to the selection unit 68 of FIG. 9 or the attenuation unit 68*a* of FIG. 12.

To the control input $C_{90}$ frequency-specific or frequency band-specific control signals are applied, which control for each frequency-specific or frequency band-specific samples at the output of TFC unit 82*b*, how it is passed to input $E_{84b}$ of the beamformer processing unit 84. Binary passing/not passing samples of the respective frequency or frequency band according to the respective frequency- or frequency band-specific control signal to $C_{90}$, means switching the beamforming ability of the beamforming processing unit 84 for the specific frequencies considered on and off.

Whenever samples of a specific frequency or frequency band are blocked by control unit 90 for that specific frequency or frequency band, beamforming ability of processor unit 84 ceases. There results namely, in that case that such samples of the considered frequencies or frequency bands are only fed to processor unit 84 from the one remaining input converter, according to FIG. 13 from converter 80*a*. Thereby, here too, it might be advisable not to binarily switch beamforming ability on and off. Therefore it might be advisable on one hand to provide the control signals to $C_{90}$ via a low-pass type unit 74*a*, operating as was explained in context with FIG. 12 for unit 74 and/or to construe control unit 90 as a frequency- or frequency band-specific attenuation unit according to unit 68*a*, which was explained with the help of FIG. 12 in context with the third aspect of the present invention.

Under a generic aspect the frequency- or frequency band-specific control signals $SC_{90}$ of FIG. 13 are generated from a control unit 92, which generates at its output $A_{92}$ frequency- or frequency band-specific control signals for the frequency of frequency band-specific beamformer ability of acoustical/electrical converter and beamformer arrangement 80.

With an eye on noise canceling it is thereby preferred that the addressed control unit 92 is a frequency- or frequency band-selective noise detector especially a wind noise detector.

Switching back to the third aspect of the present invention as disclosed in FIG. 9, the normalizing unit 62 and the comparing unit 64, to which the roll-off characteristic is fed from unit 66 represent in fact a frequency- or frequency band-selective noise detector unit, thereby even a wind noise detector unit. As has been described, whenever at unit 64 a predetermined comparison result is achieved, the respective frequency-specific or frequency band-specific control signal at the output of that unit 64 is indicative of such a result, and in analogy when the respective comparison result is negative. Therefore, a control unit 90 as of FIG. 13 is preferably construed by a normalizing unit as of 62, a comparing unit 64 and storing unit 66 as of FIG. 9.

In a most preferred embodiment the invention according to the fourth aspect is combined with the invention according to the third aspect. In the embodiment of FIG. 9, on one hand, the input converter arrangement 60 is construed as an input converter arrangement 80 of FIG. 13. On the other hand, the output of comparing unit 64 is additionally to be operationally connected to the control input $C_{68}$ of selection unit 68, operationally connected to the input $C_{90}$ of such input converter arrangement 80.

By such a combination a most advantageous effect is reached: Whenever samples of a predetermined frequency or frequency band are more and more attenuated or are blocked at selection unit 68 or, respectively, at amplification unit 68*a* as of FIG. 12, simultaneously beamforming ability of the beamforming processing unit 84 with respect to that frequency or frequency band will be attenuated as well or even completely stopped. By latter action the roll-off function for that specific frequency or frequency band does not prevail anymore, because roll-off behavior results from beamforming. Because for the frequency or frequency band considered, roll-off behavior does not anymore prevail, there will appear at the output $A_{80}$ (FIG. 13) the respective frequency or frequency band component unattenuated by roll-off. Back to FIG. 9, this will lead at comparing unit 64 to the normalized value largely exceeding the roll-off value at the considered frequency or frequency band, thereby accelerating the increase of attenuation for such sample at unit 68/68*a*.

Thus, combining the teachings of the fourth aspect and of the third aspect of the present invention leads to improved noise canceling, thereby especially wind noise canceling at an acoustical device, thereby especially a hearing device and further preferably a hearing aid device.

Fifth Aspect

Under the fifth aspect of the present invention a wind noise detection technique is proposed, leading to a method of manufacturing an acoustical device with wind noise or more generically wind detection ability, further to a respective acoustical device and to a wind detecting method most preferably applicable for hearing devices, especially hearing aid devices.

Figure 14:
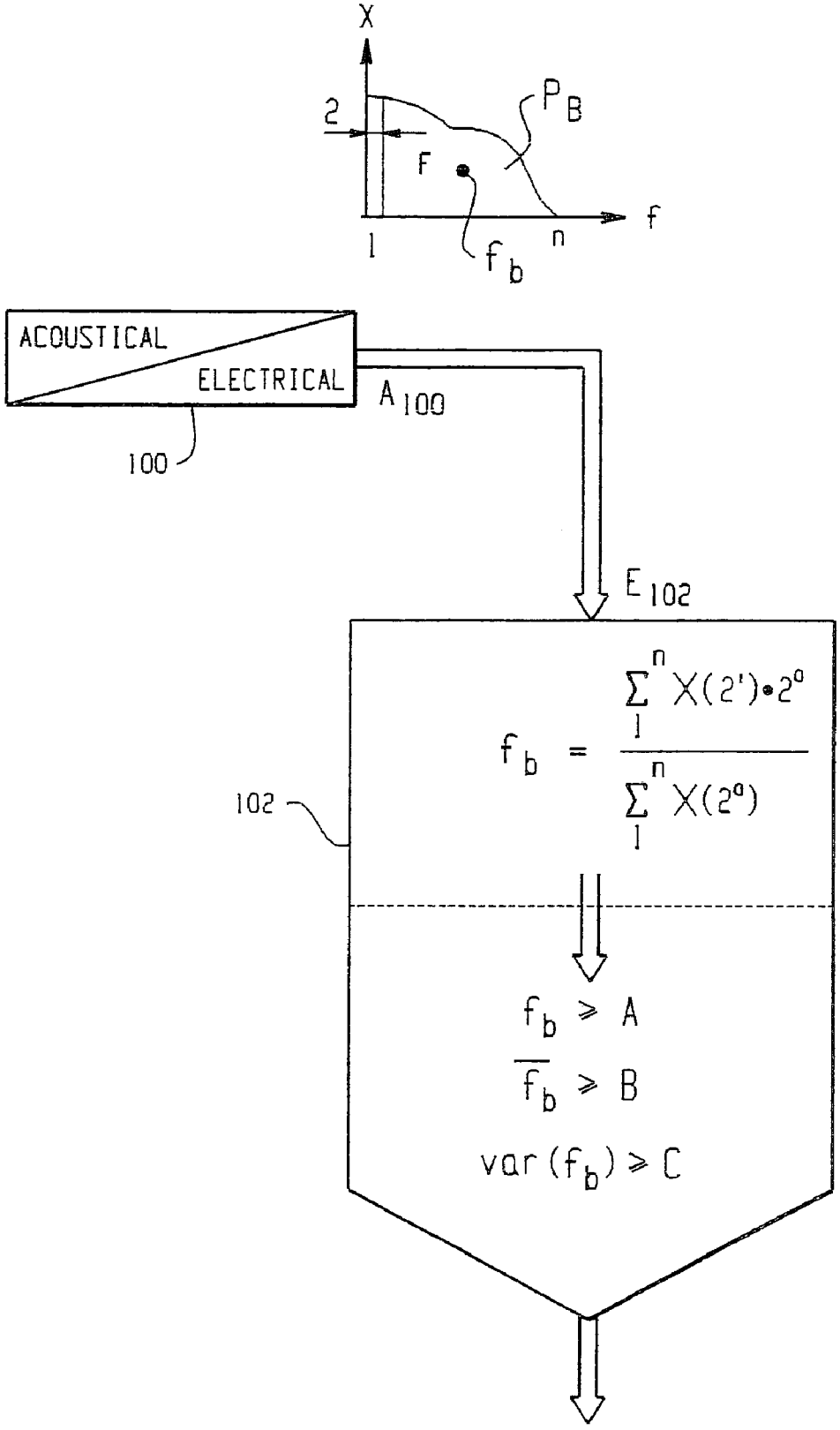

According to FIG. 14 an acoustical/electrical input converter arrangement 100 with one or more than one distinct acoustical/electrical input converters and having beamforming ability or not is provided, the output $A_{100}$ of which being operationally connected to the input $E_{102}$ of a calculating unit 102. In FIG. 14 there is schematically shown a spectrum with amplitude X over frequency axis f. The signal fed to $E_{102}$ has a spectrum which accords with or is dependent from the spectrum of acoustical signals impinging on a sensing area of the arrangement 100.

Within a predetermined frequency band the spectrum defines for a surface F. The calculation unit 102 is programmed to calculate from the spectrum at its input $E_{102}$ the frequency coordinate $f_b$ of the point of balance $P_B$ of the surface F. This is performed according to the well-known formula as indicated within the block of calculation unit 102 for calculating the balance point coordinates of a geometric surface.

Once within the calculation unit 102 the prevailing frequency coordinate $f_b$ of the balance point $P_B$ is calculated, the respective value forms the basis for deciding by evaluation, whether wind with a predetermined disturbing effect is present or not. Thereby, evaluation may comprise checking, whether the frequency coordinate value $f_b$ itself fulfills a predetermined criterion or not. Further and in a preferred embodiment the average of the frequency coordinate value is calculated continuously over a predetermined time span, and it is evaluated, whether the average value $f_b$ fulfils a predetermined criterion or not. As a third criterion the variance of the frequency coordinate $f_b$ is continuously calculated over a predetermined amount of time and again evaluation is made whether such variance value fulfills a predetermined criterion or not.

Further, evaluation is preferably done on the basis of the quotient of average value to variance value of the said frequency coordinate $f_b$ and/or on the basis of the inverse quotient. From combining two or more than two of these testing criteria there is finally evaluated whether wind and thereby wind noise is present to a disturbing amount or not. Additional evaluation parameters may be used and considered in the calculation of calculating unit 102 by respective programming, so e.g. energy of the signal applied to $E_{102}$, SNR with respect to speech signals, etc.

By the technique according to this fifth aspect of the present invention, wind detection becomes possible from an acoustical/electrical input converter arrangement, irrespective of its specific layout. The output of calculating unit 102 is used for appropriately controlling an acoustical device or for construing an acoustical device which is controlled according to the prevailing wind characteristics.

Again and with respect to the methods of manufacturing a device under all aspects of the invention, the operational connections between the various units are established preferably at least to a part before assembling the units in respective single or multiple casings. All aspects of the present invention do not address specific processing of electric signals representing audio signals according to specific device and/or individual needs. By the invention according to the present invention it is achieved—beside of wind recognition per se—that the electric signals at the output of an input acoustical to electrical converter arrangement representing audio signals are improved with respect to their relevancy on signals to be tracked as with respect to signal-to-noise ratio and thereby especially signal-to-wind noise ratio.

What is claimed is:

1. A method for reducing disturbances, especially wind disturbances, in an acoustical device, especially a hearing device with an input acoustical/electrical converter arrangement generating a first electric output signal and comprising the steps of filtering a signal dependent from said first electric signal with a variable high-pass characteristic, thereby generating a second electric signal;

adjusting said variable high-pass characteristic by a third signal dependent on said second signal;

generating said third signal in dependency of said second signal comprising performing a statistical evaluation on said second signal and generating said third signal in dependency of a result of said statistical evaluation; and evaluating by said statistical evaluation energy of said second signal and adjusting said variable high-pass characteristic in dependency of said energy so as to minimize said energy.

2. The method of claim 1 further comprising the step of performing said filtering and adjusting digitally.

3. A method for reducing disturbances, especially wind disturbances, in an acoustical device, especially a hearing device with an input acoustical/electrical converter arrangement generating a first electric output signal and comprising the steps of filtering a signal dependent from said first electric signal with a variable high-pass characteristic, thereby generating a second electric signal;

adjusting said variable high-pass characteristic by a third signal dependent on said second signal; and performing said filtering by predicting a signal dependent from the output signal of said input converter arrangement, forming a difference from a prediction result and said dependent signal and minimizing by said filtering and said adjusting said difference.

4. The method of claim 3, further comprising the step of performing said filtering and adjusting digitally.

5. A method for reducing disturbances, especially wind disturbances, in an acoustical device, especially a hearing device with an input acoustical/electrical converter arrangement generating a first electric output signal and comprising the steps of filtering a signal dependent from said first electric signal with a variable high-pass characteristic, thereby generating a second electric signal; and adjusting said variable high-pass characteristic by a third signal dependent on said second signal;

said step of performing said filtering comprising the steps of low-pass filtering a signal dependent on the output signal of said input converter arrangement with an adjustable low-pass characteristic;

comparing an output signal dependent on the result of said low-pass filtering with a signal dependent from said output signal of said input converter substantially unfiltered with respect to its frequency content;

controlling said adjustable high-pass characteristic by controlling said adjustable low-pass characteristic.

6. The method of claim 5, further comprising the step of performing said filtering and adjusting digitally.

7. A method for improving signal-to-noise ratio in an acoustical device, especially a hearing device comprising pitch filtering a signal dependent from an output signal of an acoustical/electrical input converter arrangement, monitoring the actual pitch of predominant frequency components within said dependent signal, adjusting pitch position of said pitch filtering dependent on said actual pitch position monitored.

8. The method of claim 7 further comprising the step of performing said pitch filtering on a signal dependent from said second electric signal.

* * * * *